United States Patent [19]

Yamaga et al.

[11] 4,192,212

[45] Mar. 11, 1980

[54] ELECTRONIC MUSICAL INSTRUMENT WITH AUTOMATIC PERFORMANCE DEVICE

[75] Inventors: Eiichi Yamaga; Eiichiro Aoki; Akio Imamura, all of Hamamatsu, Japan

[73] Assignee: Nippon Gakki Seizo Kabushiki Kaisha, Hamamatsu, Japan

[21] Appl. No.: 880,184

[22] Filed: Feb. 22, 1978

[30] Foreign Application Priority Data

| | | | |
|---|---|---|---|
| Feb. 24, 1977 | [JP] | Japan | 52-19507 |
| Feb. 24, 1977 | [JP] | Japan | 52-20077 |
| Feb. 25, 1977 | [JP] | Japan | 52-20079 |

[51] Int. Cl.[2] ..... G10H 1/02; G10H 5/00

[52] U.S. Cl. ..... 84/1.03; 84/1.17; 84/DIG. 22

[58] Field of Search ..... 84/1.01, 1.03, 1.17, 84/1.24, DIG. 22, DIG. 12

[56] References Cited

U.S. PATENT DOCUMENTS

| | | | |
|---|---|---|---|
| 3,825,667 | 7/1974 | Schrecongost | 84/DIG. 22 |
| 3,842,184 | 10/1974 | Kniepkamp | 84/1.01 |
| 4,022,098 | 5/1977 | Deutsch | 84/1.01 |
| 4,046,047 | 9/1977 | Roberts | 84/1.01 |
| 4,059,039 | 11/1977 | Carlson | 84/1.17 |
| 4,064,777 | 12/1977 | Akamatsu | 84/DIG. 22 |
| 4,065,993 | 1/1978 | Hirose | 84/1.03 |
| 4,100,831 | 7/1978 | Deutsch | 84/1.17 |
| 4,106,385 | 8/1978 | Roberts | 84/1.01 |
| 4,142,433 | 3/1979 | Gross | 84/1.01 |

*Primary Examiner*—J. V. Truhe
*Assistant Examiner*—William L. Feeney
*Attorney, Agent, or Firm*—Spensley, Horn, Jubas & Lubitz

[57] ABSTRACT

A keyboard electronic musical instrument comprises a note information processing device capable of processing note information required for automatic arpeggio and automatic bass performances. This note information processing device includes a generation circuit for generating a plurality of note information representing a plurality of notes to be sounded in relation to the key depression, a selection circuit for sequentially selecting a note information designating a note to be sounded from among the plurality of note information from the generation circuit in accordance with a predetermined priority order; an output circuit for delivering out the note information selected by the selection circuit, the selection at each sequence being conducted dependent on the selection at the preceding sequence. The selection circuit includes a first selector which selects note information of higher (or lower) notes than the note information outputted at the preceding sequence and a second selector which selects note information of the lowest (or highest) one from among the information selected by the first selector. The note information processing device is used commonly for the automatic arpeggio performance and the automatic bass performance in a time division manner.

16 Claims, 11 Drawing Figures

CHORD DETECTION LOGIC
DATA REGISTER
OR CIRCUITS
SUBTONE DATA FORMING LOGIC
GATE
FIRST PRIORITY CIRCUIT
DATA SELECTOR
MINOR-SEVENTH DETECTION LOGIC
PEDAL KEYBOARD NOTE MEMORY REGISTER
MEMORY
GATE FOR SINGLE FINGER
CHORD REGISTER
COINCIDENCE DETECTION CIRCUIT
ARPEGGIO REGISTER
SECOND PRIORITY CIRCUIT
LOWER KEYBOARD NOTE MEMORY REGISTER
CM
NCM
CC

ELECTRONIC MUSICAL INSTRUMENT WITH AUTOMATIC PERFORMANCE DEVICE

BACKGROUND AND SUMMARY OF THE INVENTION

This invention relates to an electronic musical instrument capable of generating information for musical tones used for an automatic performance by digital processing.

It is an object of the invention to provide an electronic musical instrument capable of processing note information which is suitable for use in automatic performance such as an automatic arpeggio performance and an automatic bass chord performance in which one or a plurality of tones are sequentially and repeatedly produced in a certain order and at a certain time interval.

There is a prior art electronic musical instrument which can perform an automatic arpeggio in which data of depressed keys in a keyboard is stored in a shift register and the tones of the depressed keys are selected one by one by scanning this shift register for producing the selected tones. In this prior art instrument, however, an order of selecting tones is constant for the selection is made simply by scanning the shift register and, accordingly, this instrument is not suitable for performing a complicated arpeggio.

According to the present invention, selection of a certain tone from among one or more tones specified by key depression is made by utilizing data of a previously produced tone. For selecting the note information, a combination of selection circuits or priority selection circuits in which the selection operation can be varied in accordance with control information is employed. In these selection circuits or priority selection circuits, data of a previously produced tone is utilized as a basis of selection. Storage means are provided for storing note information of a produced tone and the stored note information is used as the data of the previously produced tone. More specifically, priority selection circuits capable of changing a priority position in accordance with control information representing the priority position, i.e. priority information and capable also of changing a priority direction are employed and information representing a note name of a previously produced tone is utilized as the priority information for selecting information of a tone or tones which are higher (or lower) than the previously produced tone from among one or more tones specified by key depression. Further, information of a single tone (the highest or lowest tone) among the selected tone information is selected by another priority selection circuit capable of changing the priority direction. The single tone thus selected is a tone on a higher side (or a lower side) of the previously produced tone and this tone constitutes a next tone to be produced. In the above described manner, tones are sequentially produced one by one to produce an automatic arpeggio effect. Since the priority selection circuit can control the priority position or direction, selection of note information can be made in any complicated order or mode by changing contents of the control information when selection of each tone is made. Accordingly, a complicated automatic arpeggio can be performed. Further, the invention is applicable not only to the automatic arpeggio performance but to other automatic performances including an automatic bass performance in which tones to be produced are selected one by one.

It is another object of the invention to provide an electronic musical instrument which produces information of one or more tones which are in a predetermined note interval relation to a root tone selected by key depression and selects information of desired tones therefrom at a desired timing to produce tones corresponding to the selected information. In this instrument, a shift register having memory positions corresponding to notes of a chromatic scale (i.e., C–B) is provided, data representing note intervals of a desired chord is stored in this shift register and note information is provided to the respective data by shifting the data stored in the shift register in accordance with a root tone selected by key depression. The tone information thus provided with note information is selected one by one to perform a broken chord type automatic performance (Alberti bass) such as an automatic arpeggio and an automatic bass performance. Accordingly, tones of any complicated note interval relation can be produced in the automatic arpeggio performance.

It is another object of the invention to provide an electronic musical instrument in which processing means for suitably processing note information or the like obtained by depressing keys in the keyboard is commonly used, in time division multiplexing manner, for different automatic performance functions such as an automatic bass chord performance and an automatic arpeggio performance, thereby to eliminate the necessity of providing the processing means for each of the automatic performance function, that is, to permit a plurality of automatic performance functions to be effected with only one processing means.

The nature, utility and principle of the invention will become more apparent from the following detailed description when read in conjunction with the accompanying drawings, in which like parts are designated by like reference numerals or characters.

DETAILED DESCRIPTION OF THE INVENTION

Figure 1:
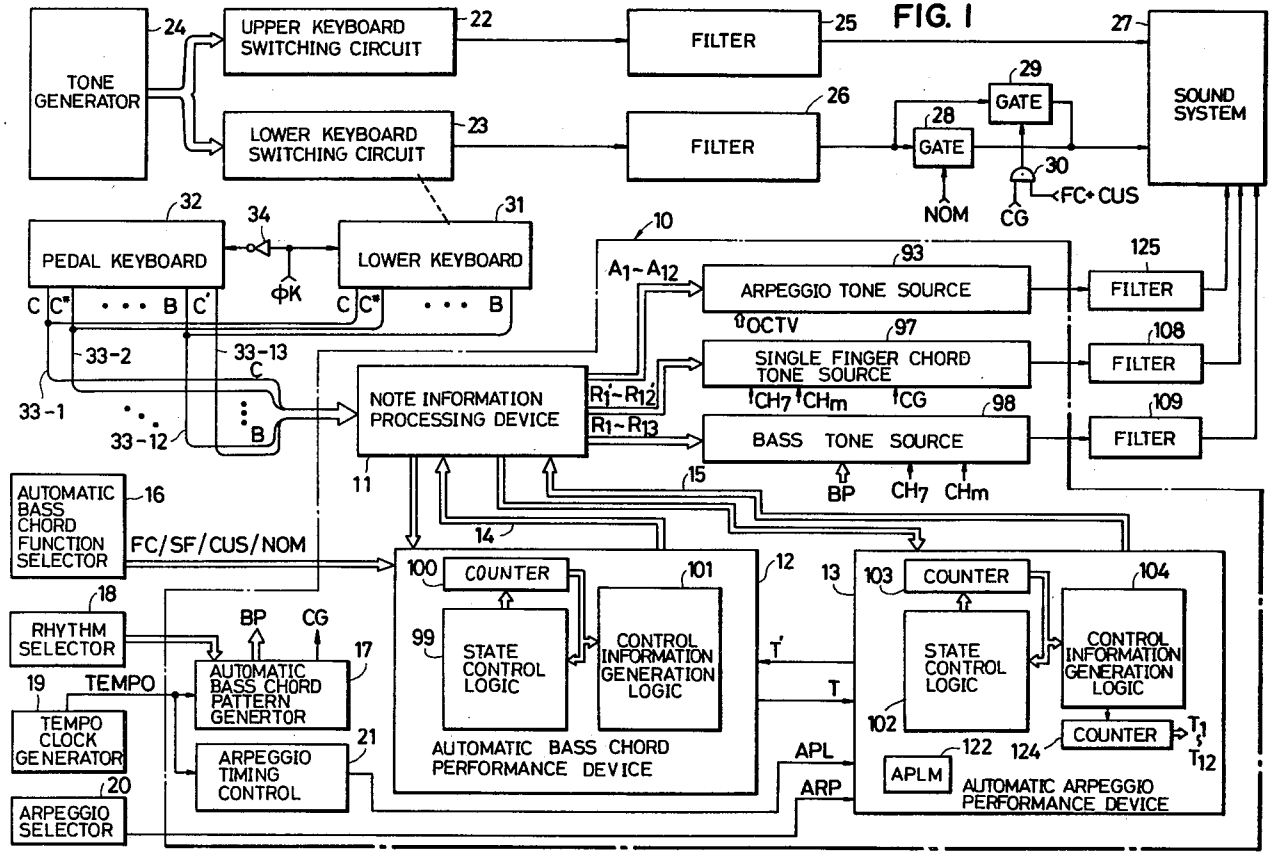
FIG. 1 is a block diagram illustrating one example of an electronic musical instrument according to this invention.

An electronic musical instrument schematically illustrated in FIG. 1 is so designed as to be able to carry out an automatic arpeggio and an automatic bass chord performance as well as an ordinary manual performance. In the electronic musical instrument, the upper keyboard is provided for a manual performance, while the lower keyboard and pedal keyboard are provided for an automatic performance. When automatic performances are not effected, the lower keyboard and the pedal keyboard are, of course, used for the manual (non-automatic) performance.

In an automatic performance section 10, a single note information processing device 11 is utilized, in a time division manner, for two automatic performance functions; that is, the automatic bass chord performance and the automatic arpeggio performance. The processing contents of the note information processing device 11 are different depending on the automatic bass chord performance and the automatic arpeggio performance; however, the circuitry thereof is so designed as to be used for both of the performances, and the processing operation is carried out in accordance with the contents of control information supplied thereto through control lines 14 and 15. An automatic bass chord performance device 12 operates to supply through the control line 14 the control information which is employed for utilizing the processing contents of the note information processing device 11 for the automatic bass chord performance. An automatic arpeggio performance device 13 operates to supply through the control line 15 the control information which is employed for utilizing the processing information of the note information processing device 11 for the automatic arpeggio performance. Time division operation control signals T and T' are transmitted and received between the automatic bass chord performance device 12 and the automatic arpeggio performance device 13. Upon application of the signal T' to the device 12 from the device 13, the automatic bass chord performance device is placed in operating state, while upon application of the signal T to the device 13 from the device 12, the automatic arpeggio performance device 13 is placed in operable condition. As the devices 13 and 12 are so designed that they are not made operable at the same time, the control information for automatic bass chord and the control information for automatic arpeggio are applied, in time division manner, through the control lines 14 and 15. Thus, the note information processing device 11 can be utilized for the two automatic performance functions. the note information processing device 11 operates to suitably process one or plural note information applied to designate a chord or a root (fundamental note) thereby to provide note information, root information and chord information for automatic bass, automatic chord or automatic arpeggio. In this embodiment, such note information is applied to the note information processing device 11 by depressing a key in the lower keyboard or the pedal keyboard.

In the automatic bass chord performance to be effected in this embodiment, one out of three functions can be selected. The first function is "a finger chord function" in which an automatic chord performance is effected by simultaneously producing plural tones for keys depressed in the lower keyboard, for every desired automatic chord tone production timing, and a chord name composed by the notes of the keys depressed in the lower keyboard is detected to automatically produce a bass tone corresponding to the chord name thereby to carry out the automatic bass performance. The second function is "a single finger function" in which a single key corresponding to a desired root is depressed in the lower keyboard, a type (kind) of chord is specified by suitable means thereby to form a plurality of chord composing tones, which are produced for the chord tone production timing, and a bass tone corresponding to the chord is automatically produced. In this embodiment, by depressing a white key in the pedal keyboard a seventh chord is designated in the case of the "single finger function", while by depressing a black key in the pedal keyboard a minor chord is designated. Furthermore, when a major chord is to be designated, no key in the pedal keyboard is depressed. The third function is "a custom function", in which an automatic chord performance is effected by simultaneously producing one or plural tones of keys depressed in the lower keyboard, for every desired automatic chord tone production timing, and the root of a bass tone is specified by depressing a key corresponding to a desired tone. In addition, a type (major, minor or seventh) of a chord composed by the tones of depressed keys in the lower keyboard is detected, and the automatic bass performance is effected according to the detected type of chord with the tone of the key depressed in the pedal keyboard as the root.

An automatic bass chord function selector 16 is to select one out of the above-described three functions, in which a finger chord function selection signal FC, a single finger function selection signal SF, or a custom function selection signal CUS is produced according to the performer's selection. When none of the three functions are selected, that is, when the automatic bass chord performance is not selected, a normal signal NOM is produced. These signals FC, SF, and CUS produced by the selection in the automatic bass chord selector 16 are utilized in an automatic performance section 10 and other sections.

The interval of a bass tone to be produced in the automatic bass chord performance, and the tone production timing thereof are determined by bass pattern information BP produced by an automatic bass chord pattern generating section 17. This section 17 operates to generate the bass pattern information BP and a chord tone production timing signal CG with a tone production pattern and an note degree pattern which correspond to a rhythm selected by a rhythm selector 18.

The bass pattern information BP will have contents representing note degrees (for instance, first, third, fifth or seventh degrees) with the timing when the bass tone of the respective degree is to be produced. The level of the chord tone production timing signal CG is raised to the level "1" with the timing when a chord tone is to be produced. A fundamental tempo clock pulse TEMPO for setting a fundamental tempo for the purpose of generating the bass pattern information, the chord tone production timing signal CG, and an arpeggio tone production timing signal APL (described later) is supplied by a tempo clock generator 19.

The automatic arpeggio performance has a function in which one or plural tones (notes) corresponding to keys depressed in the lower keyboard are produced, one at a time, in a predetermined order and at a predetermined time interval, and this sequential (successive) tone productions are repeated over one or several octaves. In the embodiment, in addition to the above-described ordinary automatic arpeggio function, "a chord arpeggio function" can be selected. In the chord arpeggio function, a single key corresponding to a root is depressed in the lower keyboard, tones in predetermined interval relation to the root (hereinafter referred to as "a subtone" when applicable) are automatically formed, and the root and the subtones are produced one at a time, thereby to carry out the automatic arpeggio performance. When the automatic arpeggio performance is selected by the operation of the arpeggio selector 20, the level of an automatic arpeggio selection signal ARP is raised to the "1" level, and the control and process for the automatic arpeggio performance are carried on in the automatic performance section 10. If, when the "single finger function" has been selected in the automatic bass chord function selector 16, the automatic arpeggio is selected by the arpeggio selector 20, the "chord arpeggio function" is selected instead of the ordinary automatic arpeggio performance. An arpeggio tone production timing signal APL for producing the automatic arpeggio one tone at a time is produced by an arpeggio tone production timing control circuit 21. For instance, the arpeggio tone production timing control circuit 21 generates the arpeggio tone production timing signal APL by suitably frequency-dividing the fundamental tempo clock pulse TEMPO.

Upon depression of a key in the upper or lower keyboard, a tone source signal corresponding to the frequency of the depressed key is selected out of a tone generator 24 through an upper keyboard switching circuit 22 or a lower keyboard switching circuit 23, and is applied through a tone color control filter 25 or 26 and through suitable circuits (not shown) to a sound system 27 where it is produced. The system of the lower keyboard switching circuit 23, the tone generator 24 and the filter 26 is employed as the tone source of automatic chord tones in the automatic bass chord performance including the "finger chord function" and the "custom function". For this purpose, in this system gates 28 and 29 for analog signal are provided in parallel to each other, and when the automatic bass chord performance has not been selected, that is, when the aforementioned normal signal NOM is at the logic level "1", the gate 28 is rendered conductive, as a result of which the lower keyboard tone is produced in accordance exactly to the key depression in the lower keyboard. When the "finger chord function" or the "custom function" is selected, an AND circuit 30 is enabled by the signal "FC+CUS", and accordingly the gate 29 is rendered conductive every generation timing of the chord tone production timing signal CG, as a result of which the lower keyboard tone is produced as an automatic chord tone.

The lower keyboard has keys over plural octaves. A lower keyboard circuit 31 is so designed that keys switches having the same notes in the octaves are commonly connected together, respectively thereby to output key depression information corresponding to 12 notes ranged from C to B. The pedal keyboard has thirteen keys ranged from $C_2$ to $C_3$, that is, one octave plus one note. A pedal keyboard circuit 32 outputs key depression information of each key. In FIG. 1, the outputs of the pedal keyboard circuit 32 corresponding to 12 keys ranged from $C_2$ to $B_2$ in the pedal keyboard are indicated by reference characters C through B, and the output for the key of note $C_3$ higher by one octave is indicated by C'. The outputs of 12 notes C through B of the lower keyboard circuit 31 and the pedal keyboard circuit 32 are connected to twelve lines 33-1 through 33-12; however, it should be noted that the outputs concerning the same note are connected to one line. The output of note C higher than note B, that is the output C' is connected to a line 33-13. The note information applied to the lines 33-1 through 33-13 is applied, as information representing the note of a key depressed in the lower keyboard or in the pedal keyboard, to the note information processing device 11. In this embodiment, the note information is employed regardless of an octave; however, note information over plural octaves may be employed. In the case of the pedal keyboard, all the note information of thirteen keys including the key of the highest note $C_3$, or C', is applied to the note information processing device 11 so that all the keys in the pedal keyboard can be used when the automatic bass chord performance is not carried out (or the normal signal NOM is at the level "1") and when the custom function of the automatic bass chord performance is performed.

The reason why the note outputs of the lower keyboard and the note outputs of the pedal keyboard are commonly connected to the lines 33-1 through 33-12 is that it is intended to apply, in time division manner, the key depression information of the lower keyboard and the key depression information of the pedal keyboard to the lines 33-1 through 33-12. A keyboard time division clock pulse $\phi K$ with a relatively long period (6 ms for instance) and a duty cycle $\frac{1}{2}$ is applied to the lower keyboard circuit 31. A signal obtained by inverting this signal $\phi K$ by an inverter 34 is applied to the pedal keyboard circuit 32. A signal "1" is applied, in time division multiplexing manner, to the lower keyboard circuit 21 in the first half period of the clock pulse $\phi K$ and to the pedal keyboard circuit 32 in the second half period of the clock pulse $\phi K$, and furthermore this signal "1" is applied to the lines 33-1 through 33-13 through key switches depressed. Accordingly, when the keyboard time division clock pulse $\phi K$ is at the level "1", the note information of keys depressed in the lower keyboard is applied to the lines 33-1 through 33-12, and when the clock pulse $\phi K$ is at the level "0", the note information concerning keys depressed in the pedal keyboard is applied thereto.

Figure 2:
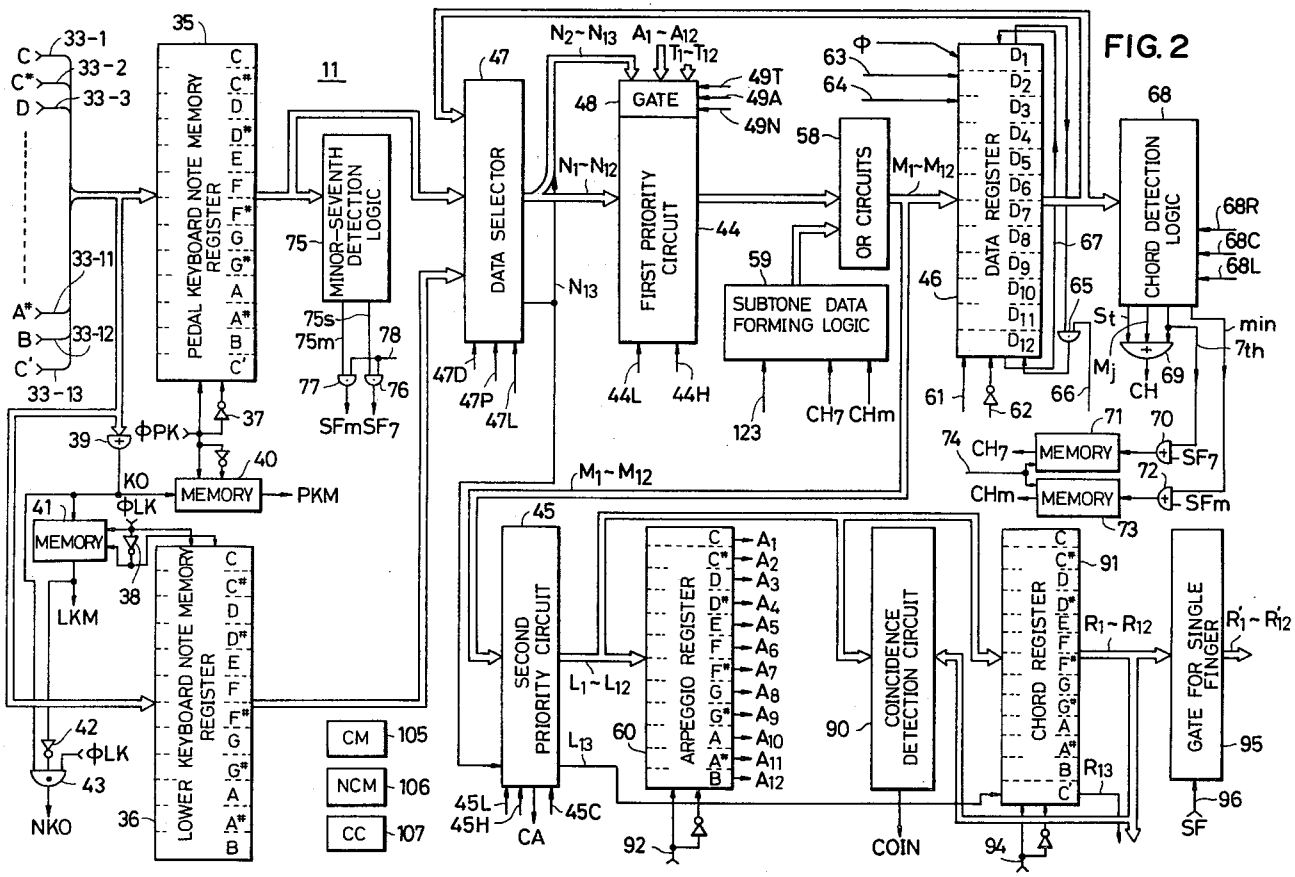
FIG. 2 is a block diagram showing one example of a note information processing device in the electronic musical instrument shown in FIG. 1.
Figure 3:
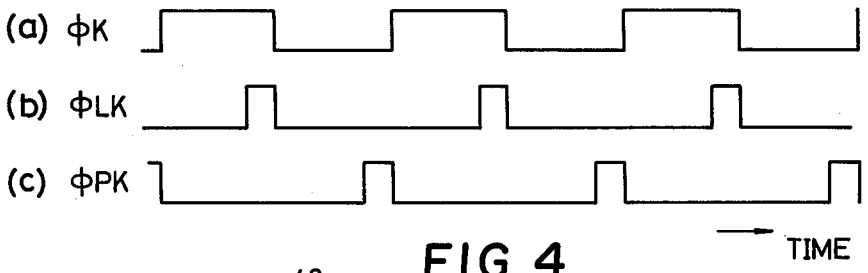
FIG. 3 is a timing chart indicating the relationships between clock pulses employed for processing, in time division manner, key depression information from the keyboard of the electronic musical instrument shown in FIG. 1.

Shown in FIG. 2 is a block diagram illustrating the note information processing circuit 1 in more detail. The key depression note information of the pedal keyboard which is supplied through the lines 33-1 through 33-13 is stored in a pedal keyboard note memory register 35, while the key depression note information of the lower keyboard which is supplied through the line 33-1 through 33-12 is stored in a lower keyboard note memory register 36. The pedal keyboard note memory register 35 is a parallel-input-parallel-output type register having thirteen memory positions, and operates to store the key depression data of the notes C through B and C' on the lines 33-1 through 33-13 in the respective memory positions. The lower keyboard note memory register 36 is a parallel-input/parallel-output type register having twelve memory positions, and operates to store the key depression data of the notes C through B on the lines 33-1 through 33-12 therein. The part (a) of FIG. 3 shows the keyboard time division clock pulse $\phi K$ for supplying, in time division manner, the key depression note information of each keyboard to the lines 33-1 through 33-13. As was described before, when this pulse $\phi K$ is at the level "1", the lower keyboard information is supplied, when it is at the level "0", the pedal keyboard information is supplied. In this connection, as shown in the part (b) of FIG. 3, a lower keyboard load pulse $\phi LK$ is produced in synchronization with a part of the time at which the pulse $\phi K$ has the level "1", while as shown in the part (c) of FIG. 3, a pedal keyboard load pulse $\phi PK$ is produced in synchronization with a part of the time at which the pulse $\phi K$ has the level "0". And when the pedal keyboard load pulse $\phi PK$ is at the level "1", the data on the lines 33-1 through 33-13 are written in the pedal keyboard note memory register 35, while when the pulse $\phi PK$ is at the level "0", the data stored in the memory register 35 are held. On the other hand, when the lower keyboard load pulse $\phi LK$ is at the level "1", the data on the lines 33-1 through 33-12 are written in the lower keyboard note memory register 36, while when it is at the level "0", the data stored therein are held. That is, when the pulse $\phi PK$ or $\phi LK$ is at the level "1", the hold signal is lowered to the level "0" by means of an inverter 37 or 38; while the pulse $\phi PK$ or $\phi LK$ is at the level "0", the hold signal is raised to the level "1". Thus, the key depression note information of the pedal keyboard supplied through the lines 33-1 through 33-13 in time division manner is correctly stored in the pedal keyboard note memory register 35, and the key depression note information is outputted in DC by the register 35. Similarly, the key depression note information of the lower keyboard is stored in the lower keyboard note memory register 36, and the key depression note information is outputted in DC by the register 35. For instance, it is assumed that only the key $C_2$ in the pedal keyboard is depressed. Then, the signal "1" applied through the line 33-1 is stored in the memory position corresponding to the note C in the pedal keyboard note memory register 35, while the signals "0" are stored in other memory positions. Similarly, the signal "1" is stored in the memory position, corresponding to the note of a key depressed in the lower keyboard, in the lower keyboard note memory register 36.

All the signals on the note lines 33-1 through 33-13 are applied to an OR circuit 39. When a key is depressed, the output of the OR circuit 39 has the signal "1" which is utilized as a key depression detection signal KO. The generation of the key depression detection signal KO with the timing of the pedal keyboard load pulse $\phi PK$, represents that a key is depressed in the pedal keyboard, and the signal KO is stored in a pedal keyboard key depression memory 40. When a key is depressed in the pedal keyboard, the output, or pedal keyboard key depression memory signal PKM, of the memory 40 has a logic level "1" in a DC mode. The generation of the key depression detection signal KO with the timing of the lower keyboard load pulse $\phi LK$ represents that a key is depressed in the lower keyboard, and the signal KO is stored in a lower keyboard key depression memory 41. When a key is depressed in the lower keyboard, the output, or lower keyboard key depression memory signal, of the memory 41 has a logic level "1" in a DC mode. Since the storages in the memories 40 and 41 are rewritten with the generation timing of the load pulses $\phi PK$ and $\phi LK$, upon release of the key, the levels of the storages in the memories 40 and 41 are lowered to the "0" In this connection, when a key in the lower keyboard is initially depressed, the signal "1" has not been stored in the memory 41 yet; however, the key depression detection signal KO applied to the memory 41 has the level "1". Therefore the key depression detection signal KO, a signal obtained by inverting the lower keyboard key depression detection signal LKM by an inverter 42, and the lower keyboard load pulse $\phi LK$ are applied to an AND circuit 43, where it is detected that a key is newly depressed in the lower keyboard. The output "1" of the AND circuit 43 is utilized as a new key-on signal NKO.

In the note information processing device 11, the key depression note data supplied from the pedal keyboard note memory register 35 or the lower keyboard note memory register 36 are processed variously according to the automatic performance functions, and the process is effected by using, in time division manner, the various circuits, provided at the post stage of the memory registers 35 and 36, in the processing device 11. The various circuits in the note information processing device 11, especially a first priority circuit 44, a second priority circuit 45 and a data register 46 are so designed that they can perform multiple functions and that the operating functions can be switched according to the contents of control information applied thereto.

The data of the notes C through B and C' stored in the pedal keyboard note memory register 35 are applied to a data selector 47, and when a pedal keyboard selection control line 47P has the signal "1", the data are selected by the data selector 47 and are introduced to output lines $N_1$ through $N_{12}$ and $N_{13}$. The data of the notes C through B stored in the lower keyboard note memory register 36 are applied to the data selector 47, and when a lower keyboard selection control line 47L has the signal "1", the data are selected by the data selector 47 and are introduced to the output lines $N_1$ through $N_{12}$. The data selector 47 operates to select one of the three input data according to the signals on the control lines 47L, 47P and 47D, and the output of a data register 46 is applied as another input data to the data selector 47. When the selection control line 47D has the signal "1", the data selector 47 selects data stored in the data register 46 and introduces the data to the output lines $N_1$ through $N_{12}$.

The data of the output lines $N_1$ through $N_{12}$ of the data selector 47 are applied, as selected data, to the first priority circuit 44. The first priority circuit 44 is so designed that twelve selected data $N_1$ through $N_{12}$ can be suitably selected in an upper priority order or a lower priority order. When an upper priority control line 14H has the signal "1", the upper priority order is employed, while when a lower priority control line 44L has the signal "1", the lower priority order is employed. In addition, in the order of the selected data $N_1$ through $N_{12}$, the data $N_1$ has the lowest order and the data $N_{12}$ has the highest order. In the case of the upper priority order, the priority is effected in the order of $N_{12}$, $N_{11}$, $N_{10}$, . . . $N_2$ and $N_1$. In contrast, in the case of the lower priority order, the priority is effected in the order of $N_1$, $N_2$, $N_3$ . . . $N_{11}$ and $N_{12}$. As the note data C, $C^{\#}$, · · · $A^{\#}$ and B become the data $N_1$, $N_2$ . . . $N_{11}$ and $N_{12}$ respectively, the term "upper priority" means a high tone priority, while the term "lower priority" means a low tone priority. Furthermore, the first priority circuit 44 is so designed that the priority position can be switched according to the priority information. And, as for the priority information to be used, one of three pieces of information $N_2$ through $N_{13}$, $A_1$ through $A_{12}$, and $T_1$ through $T_{12}$ is selected by a priority information selection gate 48. The term "priority information" is intended to mean information for specifying a part (which is the upper part or the lower part) of the selected data $N_1$ through $N_{12}$ to be selected with priority. Therefore, if the content and priority direction (upper or lower) of the priority information employed in the first priority circuit 44 is changed, the contents of the priority selection operation in the first priority circuit 44 are variously changed.

The pieces of priority information $N_2$ through $N_{13}$ are the signals on the data lines $N_2$ through $N_{13}$ which are outputted by the data selector 47, and when the signal on a priority information selection control line 49N is at the level "1", they are selected by the selection gate 48 and are utilized in the first priority circuit 44. The priority iinformation $A_1$ through $A_{12}$ are data supplied by an arpeggio register 60 described later, and when the signal on a priority information selection control line 49A is at the level "1", they are selected by the selection gate 48 and are used in the first priority circuit 44. Furthermore, the priority information $T_1$ through $T_{12}$ are applied by the automatic arpeggio device 13 (FIG. 1), and when the signal on a priority information selection control line 49T is at the level "1", they are selected by the selection gate 48 and are used in the first priority circuit 44.

Figure 4:
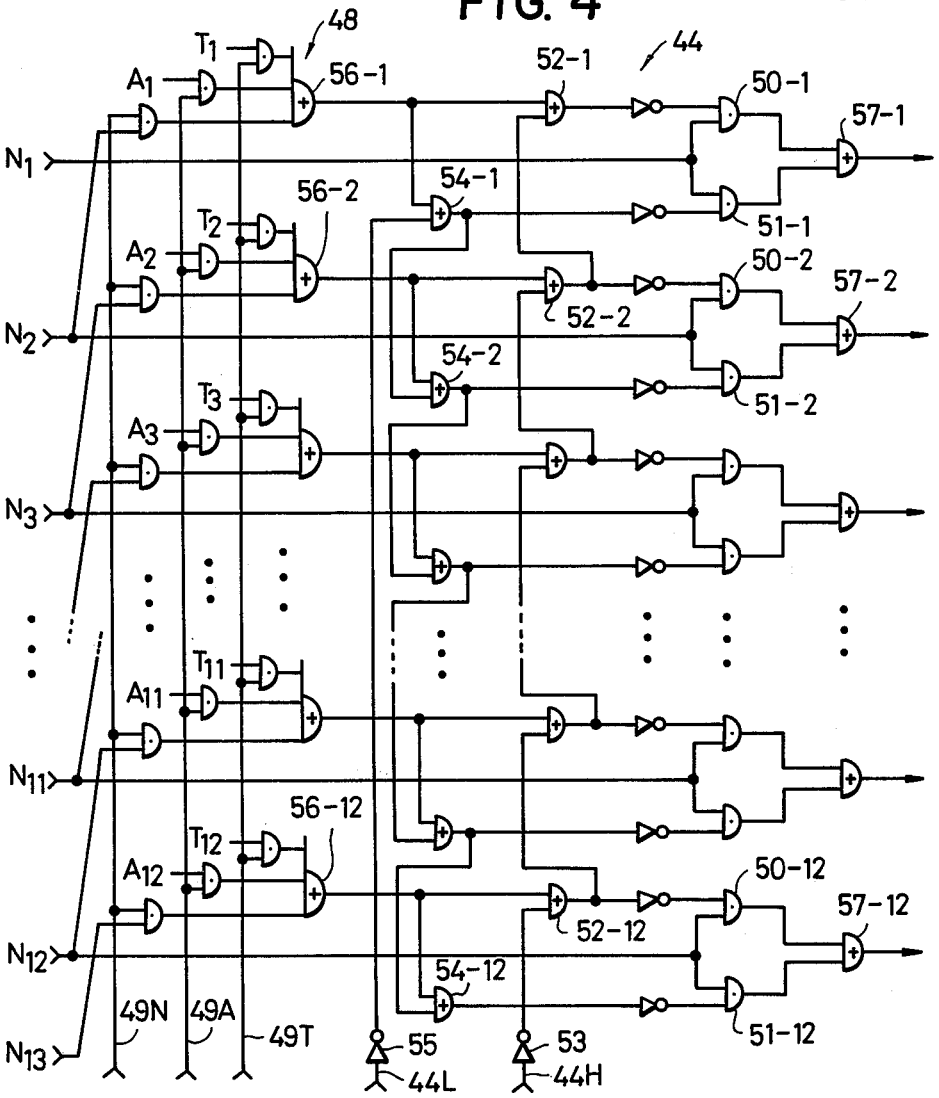
FIG. 4 is a schematic circuit diagram showing a concrete example of a first priority circuit shown in FIG. 2.

One example of the first priority circuit 44 is shown in FIG. 4. In FIG. 4, circuits relating to the data $N_4$ through $N_{10}$ are omitted for simplification in illustration; however, they may be formed in accordance with the other circuits concerning the data $N_1$ through $N_3$ and $N_{11}$ through $N_{13}$. For each of the selected data $N_1$ through $N_{12}$, two AND circuits (50-1 through 50-12, and 51-1 through 51-12) are provided, and the data $N_1$ through $N_{12}$ are applied to one inputs of the two AND circuits. In the twelve OR circuits 52-1 through 52-12 corresponding to the data $N_1$ through $N_{12}$, the outputs of the respective OR circuits are applied to the inputs of the lower OR circuits succeedingly starting from the uppermost OR circuit 52-12. The signal on the upper priority control line 44H is inverted by an inverter 53 and is applied to the uppermost OR circuit 52-12. Furthermore, in twelve OR circuits 54-1 through 54-12 corresponding to the data $N_1$ through $N_{12}$, the outputs of the respective OR circuits are applied to the inputs of the lower OR circuits succeedingly starting from the OR circuit 54-1 corresponding to the lowermost data ($N_1$). The signal on the lower priority control line 44L is inverted by an inverter 55 and is applied to the lowermost OR circuit 54-1. The outputs of the OR circuits 52-1 through 52-12 are applied to the AND circuits 50-1 through 50-12 through inverters, respectively, while the outputs of the OR circuits 54-1 through 54-12 are applied through inverters to the AND circuits 51-1 through 51-12. Furthermore, the priority information selected by the priority information selection gate 48 is applied to the OR circuits 52-1 through 52-12 and 54-1 through 54-12, respectively. The bits of the priority information $N_2$ through $N_{13}$, or $A_1$ through $A_{12}$, or $T_1$ through $T_{12}$ selected by the signal on the priority information selection control line 49N, or 49A, or 49T correspond to the positions of the selected data $N_1$ through $N_{12}$, respectively, and are applied through OR circuits 56-1 through 56-12 to the aforementioned OR circuits 52-1 through 52-12 and 54-1 through 54-12, respectively.

In the case of the upper priority, the signal on the line 44H is at the level "1", while the signal on the line 44L is at the level "0". Accordingly, the outputs or the OR circuits 54-1 through 54-12 are all at the level "1", and therefore the signal "0" are applied through inverters to the AND circuits 51-1 through 51-12. As a result, the AND circuits 50-1 through 50-12 are enabled. If, in twelve data of the priority information applied through the OR circuits 56-1 through 56-12 by the priority information selection gate 48, the data at a certain position is at the level "1", the level of the output of the OR circuit for that position and also the levels of the outputs of the OR circuits for the positions lower than the position (some of the OR circuits 52-1 through 52-12) are raised to the level "1". As a result, the AND circuits (some of the AND circuits 50-1 through 50-12) for the positions lower than the priority position represented by the priority information are disabled, and therefore the data higher than that (some of the data $N_1$ through $N_{12}$) are selected.

In the case of the lower priority, the signal on the line 44H is at the level "0", while the signal on the line 44L is at the level "1". Therefore, conversely to the case of the upper priority, the levels of the outputs of the OR circuits 52-1 through 52-12 are raised to the level "1", and all the AND circuits 50-1 through 50-12 are therefore disabled. If data at a certain position in twelve data of the priority information applied through the OR circuits 56-1 through 56-12 is at the level "1", then the levels of the outputs of the OR circuits for that position and the positions higher than the position (some of the OR circuits 54-1 through 54-12) are raised to the level "1". As a result, all the AND circuits for the positions higher than the priority position specified by the priority information (some of the AND circuits 51-1 through 51-12) are disabled, and therefore the data lower than that (some of the data $N_1$ through $N_{12}$) are selected.

In the case when the data $N_2$ through $N_{13}$ are selected as the priority information for the selected data $N_1$ through $N_{12}$ with the aid of the signal of the control line 49N, the signal on the upper priority control line 44H is raised to the level "1", and the upper priority selection is thereby performed. In this case, the first priority circuit 44 is used as a circuit to select the uppermost data "1".

The data selected by the first priority circuit 44 are outputted through the OR circuits 57-1 through 57-12. The positional relationships between the selected data $N_1$ through $H_{12}$ and the priority information $N_2$ through $N_{13}$, $A_1$ through $A_{12}$ and $T_1$ through $T_{12}$ are indicated in Table 1 below:

Table 1

| Priority information | $N_2$ $N_3$ $N_4$ $N_5$ $N_6$ $N_7$ $N_8$ $N_9$ $N_{10}$ $N_{11}$ $N_{12}$ $N_{13}$<br>$A_1$ $A_2$ $A_3$ $A_4$ $A_5$ $A_6$ $A_7$ $A_8$ $A_9$ $A_{10}$ $A_{11}$ $A_{12}$<br>$T_1$ $T_2$ $T_3$ $T_4$ $T_5$ $T_6$ $T_7$ $T_8$ $T_9$ $T_{10}$ $T_{11}$ $T_{12}$ | | |
|---|---|---|---|
| Selected Data | $N_1$ $N_2$ $N_3$ $N_4$ $N_5$ $N_6$ $N_7$ $N_8$ $N_9$ $N_{10}$ $N_{11}$ $N_{12}$ | | |
| Lower | Selection | $T_6$ | |
| Upper | | $T_6$ | Selection |

In Table 1, the selection contents obtained when the data $T_6$ in the priority information $T_1$ through $T_{12}$, for instance, is at the level "1", are indicated with respect to the cases of the lower priority and the upper priority. In the case of the lower priority, the data $N_1$ through $N_5$ lower than the data $N_6$ corresponding to the position of the priority data $T_6$ are selected. On the other hand, in the case of the upper priority, the data $N_7$ through $N_{12}$ higher than the data $N_6$ corresponding to the data $T_6$ are selected. Furthermore, if when out of the selected data $N_1$ through $N_{12}$, only the data $N_3$ and $N_6$ are at the level "1" are remaining data are at the level "0", the upper priority is selected by the use of the priority information $N_2$ through $N_{13}$, then the data $N_1$ through $N_5$ lower than the selected data $N_6$ are blocked by the priority data $N_6$ while the selected data $N_6$ through $N_{12}$ are selected, and therefore the uppermost data $N_6$ is selected with priority.

For releasing the priority selection function in the priority circuit 44, the signals on the priority control lines 44H and 44L are raised to the level "1" whereas signals on the priority information selection control lines 49N, 49A and 49T are lowered to the level "0". In this case, the input data $N_1$ through $N_{12}$ are outputted, as they are, through the AND circuits 50-1 through 51-12 and the OR circuits 57-1 through 57-12. When it is required to prevent the passage of the data $N_1$ through $N_{12}$ in the priority circuit 44, the signals on the control lines 44H and 44L are lowered to the level "0" thereby to disable the AND circuits 50-1 through 51-12.

The twelve data outputted through the OR circuits 57-1 through 57-12 (FIG. 4) by the first priority circuit 44 are applied through the OR circuit group 58 (FIG. 2) to the data lines $M_1$ through $M_{12}$, respectively. The OR circuit group 58 is provided to supply to the data lines $M_1$ through $M_{12}$ the subtone data generated by a chord arpeggio subtone data forming logic 59 in the case of the "chord arpeggio function". The output of the first priority circuit 44 and the output of the chord arpeggio subtone data forming logic 59 are not simultaneously applied to the OR circuit group 58, that is, one of the data groups is applied to the data lines $M_1$ and $M_{12}$.

The signals on the data lines $M_1$ through $M_{12}$ are applied to the data input terminal of a data register 46 and to the selected data input terminal of a second priority circuit 45. The data register 46 is a parallel-input parallel-output type register which has twelve memory positions $D_1$ through $D_{12}$ and can carry out the shifting operation in a series mode. The shifting direction and data circulation of the register 46 is controlled in accordance with the control information. The shifting clock pulse $\phi$ is a high speed clock pulse having a period of approximately 1 $\mu$s. When the signal of the load control line 61 is raised to the level "1", the signals on the data lines $M_1$ through $M_{12}$ are written in the memory positions $D_1$ through $D_{12}$ of the data register 46, respectively. In this operation, the signal on the hold line 62 is at the level "1", and it is inverted to the level "0" by an inverter, as a result of which the holding operation is inhibited. When the signal of the hold line 62 is at the level "0" (which is maintained at the "0" level before the signal "1" is applied), the signal "1" is applied through an inverter to the data register 46, and therefore the data in the memory positions $D_1$ through $D_{12}$ are held. When the signal on a left shift control line 63 is raised to "1", the contents of the memory positions $D_1$ through $D_{12}$ are shifted left with the aid of the clock pulse $\phi$. The term "left shift" is intended to mean that shifting is effected in a direction from the memory position $D_{12}$ to the memory position $D_1$. In the left shift, the output data of the leftmost memory position $D_1$ (corresponding to the input data $M_1$) is appied to the rightmost memory position $D_{12}$ through an AND circuit 65. This AND circuit 65 is enabled when the signal on the left shift circulation control line 66 is at the level "1", thereby permitting the data shift register 46 to operate as a circulation type shift register. When the signal on the right shift control line 64 is raised to "1", the data register 46 is shifted right from the memory position $D_1$ to the memory position $D_{12}$. In the right shift, the output data of the memory position $D_{12}$ is returned through the circulation line 67 to the memory position $D_1$. Thus, the data register 46 operates as a circulation type shift register at all times.

The data in the memory positions $D_1$ through $D_{12}$ in the data register 46 are outputted in a parallel mode, and are applied to a chord detection logic 68 and to the above-described data selector 47. The chord detection logic 68 is to detect a chord composed by one or pluraly keys depressed in the lower keyboard.

In the chord detection circuit 68, the chord detection operation is effected under the condition that the respective data of the memory positions $D_1$ through $D_{12}$ in the data register 46 are in semi tone relation with respect to each data which is adjacent thereto. In this connection, the degree of the leftmost memory position $D_1$ is the prime, and as the position is advanced to $D_{12}$ from $D_2$, the tone pitch is increased by semitone. The relationships between the memory positions $D_1$ through $D_{12}$ in the data register 46 and the note degrees are as indicated in Table 2 below:

Table 2

| Memory position | $D_1$ | $D_2$ | $D_3$ | $D_4$ | $D_5$ | $D_6$ | $D_7$ | $D_8$ | $D_9$ | $D_{10}$ | $D_{11}$ | $D_{12}$ |
|---|---|---|---|---|---|---|---|---|---|---|---|---|
| Degree | 1 | 2♭ | 2 | 3♭ | 3 | 4 | 5♭ | 5 | 6♭ | 6 | 7♭ | 7 |
| Major | o | | x | | | x | | o | | x | | |
| Seventh | o | | x | | | x | | | | x | o | |
| Minor | | | | o | | | | | | | | |
| Root | o | | | | | | | | | | | |

The characters 1, 2♭, 2 . . . 7♭ and 7 designate the prime, the minor second, the major second, . . . the minor seventh, and the major seventh degree notes, respectively. Indicated in the lower part of Table 2 are conditions for detecting major chords, seventh chords, minor chords and the root (first degree) note in the chord detection logic 68. The mark 0 represents the existence of the corresponding degree note, that is, the data of the corresponding position $D_1$–$D_{12}$ is at the level "1". On the other hand, the mark x represents the non-existence of the corresponding degree note, that is, the data of the corresponding position $D_1$–$D_{12}$ is at the level "0". Accordingly, in the chord detection logic 68 there are provided AND circuits for detecting the major, seventh, minor chords and the root-note in accordance with the following logical equations, respectively:

Major chord detection:

$$1\cdot\bar{2}\cdot\bar{4}\cdot 5\cdot\bar{6}=D_1\cdot\bar{D}_3\cdot\bar{D}_6\cdot D_8\cdot\bar{D}_{10} \quad (1)$$

Seventh chord detection:

$$1\cdot\bar{2}\cdot\bar{4}\cdot\bar{6}\cdot 7\flat=D_1\cdot\bar{D}_3\cdot\bar{D}_6\cdot\bar{D}_{10}\cdot\bar{D}_{11} \quad (2)$$

Minor chord detection:

$$3\flat=D_4 \quad (3)$$

Root note detection:

$$1=D_1 \quad (4)$$

In the above-described equations, the numerals in the left side designate note degrees, and the bar (—) above the numeral means that degree note is absent. The characters in the right side designate memory positions, and the bar (—) above the character means that the data of that position is at the level "0", while the character without the bar means that the data of that position is at the level "1".

When the signal on the chord detection control line 68C applied to the chord detection logic 68 is at the level "1", in the chord detection logic 68 and AND circuits (not shown) concerning equatons (1) through (3) are enabled thereby to detect the presence and absence of the major, seventh or minor chord. When the signal on a single finger root detection control line 6BR is at the level "1", in the chord detection logic 68 the AND circuit (not shown) concerning equation (4) is enabled thereby to detect data permitted to become the root of the single finger function. Application of the signals is so effected that the signals on the lines 68C and 68R are not raised to the level "1" simultaneously. When the signal on the lowest tone detection control line 68L is raised to the level "1", the AND circuit for equation (4) is enabled, thereby to detect the data of the lowest tone, or the prime degree.

The output related to the logical equation (1) is applied to a major chord detection line Mj, the output related to the equation (2) is applied to a seventh chord detection line 7th, and the output related to the equation (3) is applied to a minor chord detection line MIN. In addition, the output concerning equation (4) is applied to a single tone detection line St. The signals on the single tone detection line ST, the major chord detection line Mj, and the seventh chord detection lines 7th are applied to an OR circuit 69, as a result of which a chord detection signal CH representing the detection of a chord is provided thereby. The signals on the lines MIN and 7th are utilized as signals representing the presence and absence of minor and seventh chords.

More specifically, the signal "1" on the seventh chord detection line 7th is stored in a seventh chord memory 71 through an OR circuit 70, and a seventh signal $CH_7$ representing that the type of the chord is seventh is provided. The signal "1" on the minor chord detection line MIN stored in a minor chord memory 73 through an OR circuit 72, and a minor signal $CH_m$ representing that the type of the chord is minor is provided. Furthermore, when the signal on the load control line 74 is raised to "1", the signals from the OR circuits 70 and 72 are written in the seventh chord memory 71 and the minor chord memory 73.

In the chord detection logic 68, detection of the logics of the above-described logical equations (1) through (3) is possible only when the finger chord function or the custom function is selected, and it is impossible in the case of the single finger function. In the case of the single finger function, the type of chord is specified by depressing a white key or a black key in the pedal keyboard, and therefore the stored outputs of the notes C through B and C' in the pedal keyboard note memory register 35 are applied to a minor and seventh detection logic 35 for single finger. This logic 75 comprises OR circuits for inputting data of notes C, D, E, F, G, A, B and C' corresponding to the white keys, and OR circuits for inputing data of notes C♯, D♯, F♯, G♯ and A♯ corresponding to the black keys. The outputs of the former OR circuits are supplied to a seventh detection line **75*a*, while the outputs of the latter OR circuits are supplied to a minor detection line 75*m*. The signals on the seventh detection line 75*a* and the minor detection line 75*m* are applied to AND circuits 76 and 77, respectively. When the AND circuits 76 and 77 are enabled by the signal on the control line 78 which is raised to "1" upon selection of the single finger function, the signals on the lines 75*a* and 75*m* are outputted as a seventh detection signal $SF_7$ and a minor detection signal $SF_m$. These signals $SF_7$ and $SF_m$ are stored in the seventh chord memory 71 and the minor chord memory 73 through the OR circuits 70 and 72**.

The second priority circuit 45 operates to receive the data on the data lines $M_1$ through $M_{12}$ and the data on the data line $N_{13}$ corresponding to the highest tone C' in the pedal keyboard. In the order of the selected data $M_1$ through $M_{12}$ and $M_{13}$, the data $M_1$ has the lowest order (the lowest tone), increasing (tone pitch) in the order of $M_2$ through $M_{12}$ the data $N_{13}$ has the highest order (the highest tone). The data of the data line $N_{13}$ is not utilized in the passage extended from the first priority circuit 44 to the chord detection logic 68 because the process in this passage is not related to the pedal keyboard at all.

The second priority circuit 45 is so controlled that when the signal on the upper priority control line 45H is at "1", the highest data "1" in the input data $M_1$ through $M_{12}$ and $N_{13}$ is selected, and that when the signal on the lower priority control line 45L is at "1", the lowest data "1" in the input data $M_1$ through $M_{12}$ and $N_{13}$ is selected. Furthermore, when the signal on the priority release control line 45C is at "1", the priority selection in the second priority circuit 45 is released, and therefore the input data $M_1$ through $M_{12}$ and $N_{13}$ are outputted as they are. In the case where all the input data $M_1$ through $M_{12}$ and $N_{13}$ are at "0" in the second priority circuit 45, no data "1" is at the output side even if the upper priority or the lower priority is selected. In this case, a carry signal CA is provided.

Figure 5:
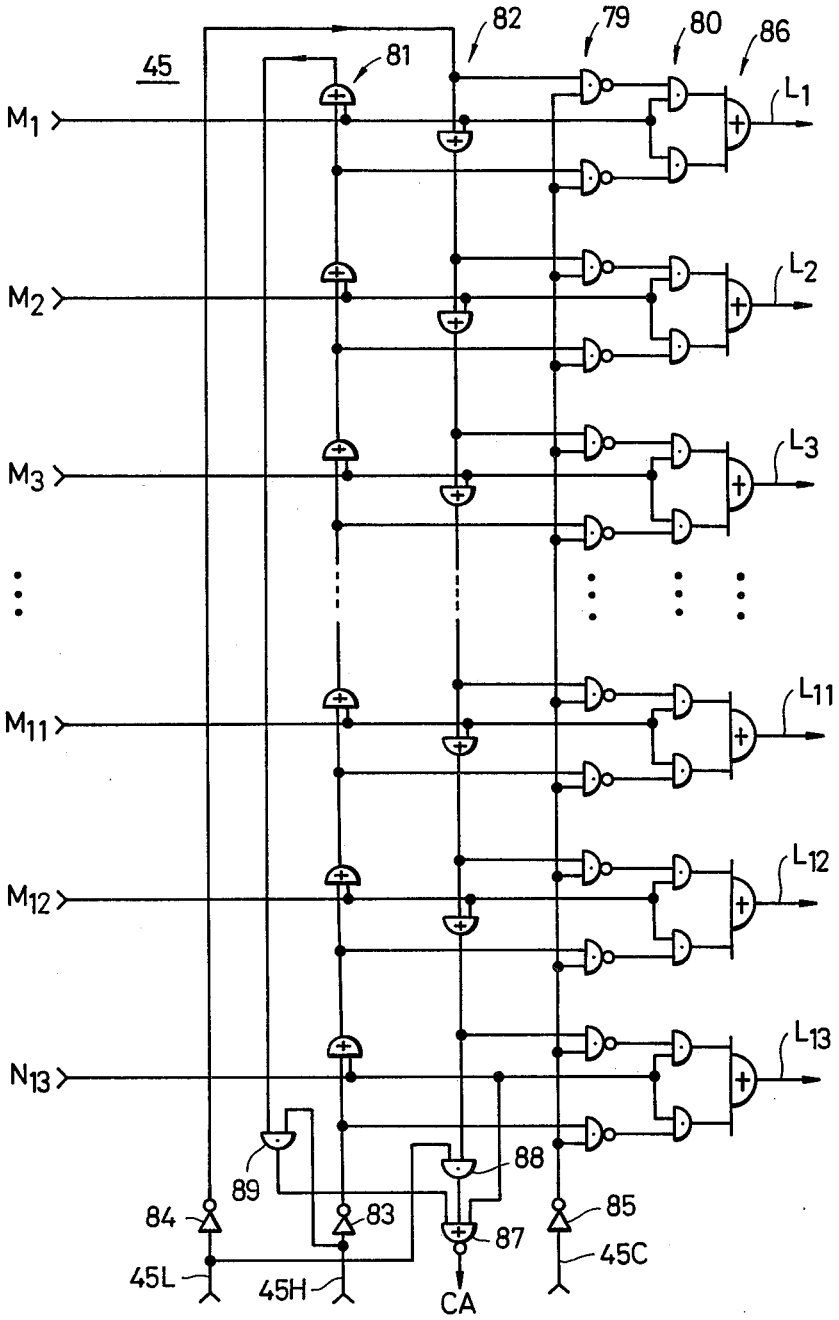
FIG. 5 is a schematic circuit diagram showing a concrete example of a second priority circuit shown in FIG. 2.

FIG. 5 is a detailed circuit diagram showing one example of the second priority circuit 45. In a NAND circuit group 79, two NAND circuits are provided for each of the input data $M_1$ through $M_{12}$, and $N_{13}$. Furthermore, in an AND circuit group 80, two AND circuits are provided for each of the input data $M_1$ through $M_{12}$ and $N_{13}$. The two NAND circuits and two AND circuit provided for each of the input data $M_1$ through $M_{12}$ and $N_{13}$ are selectively used according to the upper priority and the lower priority. A group of OR circuits 81 are cascade-connected successively in a direction from the upper data $N_{13}$, $M_{12}$ . . . to the lower data, while a group of OR circuits 82 are cascade-connected successively in a direction from the lower data $M_1$ to the upper data. The outputs of the OR circuits in the OR circuit group 81 are applied to the NAND circuits, corresponding to the lower data, in the NAND circuit group 79. On the other hand, the outputs of the OR circuits in the OR circuit group 82 are applied to the NAND circuits, corresponding to the upper data, in the NAND circuit group 79.

In the case of the upper priority, the signal "1" on the upper priority control line 45H is inverted by an inverter 83, as a result of which the signal "0" is applied to the uppermost OR circuit in the OR circuit group 81. In this operation, the signal on the lower priority control line 45L is at "0", and therefore the signal "1" obtained through an inverter 48 is applied to the OR circuit group 82. Accordingly, all the outputs of the OR circuit group 82 have "1", and all the outputs of the NAND circuits, corresponding to the lower priority, in the NAND circuit grou 79 have "0" The signal "1" is outputed by the OR circuit in the OR circuit group 81, which corresponds to the uppermost data ($M_3$ for instance) having the signal "1" in the input data $M_1$ through $M_{12}$ and $N_{13}$, as a result of which the outputs of the NAND circuits, corresponding to the data ($M_1$ and $M_2$ for instance) lower than the above-described data, in the NAND circuit group 79 are forcibly lowered to "0". Accordingly, in the AND circuit group 80, all the AND circuits corresponding to the data ($M_1$ and $M_2$ for instance) lower than the uppermost data "1" ($M_3$ for instance) are disabled. In this manner, the upper most data "1" is selected. In the case of the lower priority, the operations are opposite to those described above.

In releasing the priority, the signal on the priority release control line 45C is raised to "1", as a result of which the signal "0" is applied to all the NAND circuits in the NAND circuit group 79 through an inverter 85. Accordingly, all the AND circuits in the AND circuit group 80 are enabled, and the input data $M_1$ through $M_{12}$ and $N_{13}$ are introduced through the AND circuit group 80 and the OR circuit group 86 to the output line $L_1$ through $L_{13}$. When it is required to prevent the passage of the data, the signals on the line 45H, 45L and 45C are lowered to "0" thereby to disable the AND circuits in the AND circuit group 80. In this connection, it should be noted that the signals on the lines 45H, 45L and 45C are normally at "0" unless the signal "1" is applied thereto.

The carry signal CA is outputted by the NOR circuit 87. In the case of the upper priority or the lower priority, an AND circuit 88 or 89 is enabled by the signal "1" on the line 45H or 45L. The outputs of the OR circuit groups 82 and 81 are applied to the AND circuits 88 and 89. Therefore, if any one of the input data $M_1$ through $M_{12}$ is at "1", the signal "1" is provided by the AND circuit 88 or 89. The outputs of the AND circuits 88 and 89 and the data $N_{13}$ are applied to the NOR circuit 87, and when any one of these signals is at "1", the output of the NOR circuit 87 has "0", and therefore not carry signal CA is provided. When all these three inputs are at "0", the output of the NOR circuit 87 has "1", and therefore the carry signal CA is provided.

The data on the output lines $L_1$ through $L_{12}$ of the second priority circuit 45 correspond notes C through B, while the data on the output line $L_{13}$ corresponds to the highest tone C' in the pedal keyboard. The output line $L_1$ through $L_{12}$ of the second priority circuit 45 are connected to an arpeggio register 60, a coincidence detection circuit 90 and a chord register 91. The arpeggio register 60 is a parallel-input/parallel-output type register having twelve memory position, in which when the signal on the load control line 92 is at "1", the data on the lines $L_1$ through $L_{12}$ are stored in the memory positions, and when the signal on the load control line 92 is at "0", the data thus stored are held. The memory positions, adapted to store the data on the lines $L_1$ through $L_{12}$, in the arpeggio register 60 correspond to the twelve notes C through B, respectively. The output data $A_1$ through $A_{12}$ of the memory positions in the arpeggio register 60 are utilized as priority information for the above-described first priority circuit 44, and are applied to an arpeggio tone source section 93 (FIG. 1). As described later, data corresponding to one note to be produced as an arpeggio tone is stored in the arpeggio register 60, and therefore the arpeggio tone source section 93 produces an arpeggio tone according to the output data $A_1$ through $A_{12}$ of the arpeggio register 60.

The chord register 91 is a parallel-input/parallel-output type register having thirteen memory positions, in which when the signal on the load control line 94 is at "1", the data on the input lines $L_1$ through $L_{12}$ and $L_{13}$ are written in the memory positions, and the data thus written are held when the signal on the load control line 94 has "0". The memory positions of the chord register 91 corresponding to the data lines $L_1$ through $L_{12}$ correspond to the notes C through B, respectively, while the memory position corresponding to the line $L_{13}$ corresponds to the note C'. The chord register 91 is to store a note corresponding to the root of a chord detected by the aforementioned chord detection logic 68. The outputs $R_1$ through $R_{12}$ from the memory positions corresponding to the notes C through B in the chord register 91 are applied to a gate 95 for single finger. Where the single finger function has been selected, the signal on the gate control line 96 is raised to "1", as a result of which the data $R_1$ through $R_{12}$ are selected and introduced to the output lines $R_1'$ through $R_{12}'$. The data on these output lines $R_1'$ through $R_{12}'$ are supplied to a chord tone source section 97 for single finger (FIG. 1) The outputs $R_1$ through $R_{12}$ and output data $R_{13}$ corresponding to the note C' in the pedal keyboard are supplied to a bass tone source section 98 (FIG. 1).

In the coincidence detection circuit 90, the outputs $L_1$ through $L_{12}$ of the second priority circuit 45 are compared with the memory outputs $R_1$ through $R_{12}$, and when both coincide with each other, the coincidence detection signal COIN is raised to "1". This coincidence detection signal COIN is utilized to detect, for instance, the change of a chord caused by changing key depression in the lower keyboard.

The automatic bass chord control device 12 and the automatic arpeggio control device 13 operate to successively generate the control information according to preprogrammed contents and supply it to the note information processing device 11. In this embodiment, the automatic bass chord control device 12 can have ten control states S0 through S9. The state S0 is a standby state. A state control logic 99in the automatic bass chord control device 12 operates to advance the present state to a predetermined state when the external signal conditions satisfy predetermined conditions. The contents of a state counter 100 represent the present state, which is advanced to a predetermined state by applying a count data from the state control logic 99 to the state counter 100. A control information generating logic 101 operates to generate predetermined control information according to the processing condition of the processing device 11 and the present state. In addition, in this embodiment, the automatic arpeggio control device 13 can have seven states $ST_0$ through $ST_6$. The state $ST_0$ is a standby state. The operations of a state control logic 102, a state counter 103, and a control information generating logic 104 in the automatic arpeggio control device 13 are similar to those described above.

When the automatic arpeggio control device 13 is in the state $ST_0$, or the standby state, a time division operation control signal T' is applied to the automatic bass chord control device 12 from the device 13, as a result of which the device 12 is enabled. The automatic bass chord control 12 advances the state successively, and generates necessary control information for every state thereby to control the note information processing device 11. During this operation, the note information processing device 11 carries out the processing for the automatic bass chord performance.

If a series of controls for the standby state S0 to a final state (S9 for instance) are completed in the automatic bass chord control device 12 the time division operation control signal T is supplied to the automatic arpeggio control device 13 from the device 12 at the final state. In the automatic arpeggio control device 13, if, when the arpeggio tone production timing signal APL is applied thereto, the time division operation control signal T is applied thereto, then the standby state $ST_0$ is advanced to the next state. In the case where no arpeggio tone production timing signal APL is supplied, the automatic arpeggio control 13 is not operated, that is, the standby state $ST_0$ remains as it is, even if the time division operation control signal T is applied thereto. In this case, the time division operation control signal T' is continuously provided from the side of the automatic arpeggio control device 13, and therefore the automatic bass chord control device 12 continues its operation. That is, normally the automatic bass chord control device 12 is operated, but upon application of the arpeggio tone production timing signal APL the automatic arpeggio control device 13 is operated after the completion of a series of operations of the automatic bass chord control device 12 (after generation of the signal T). Thus, the automatic arpeggio control device 13 is operated only when the arpeggio tone production timing signal APL is applied.

However, it should be noted that the arpeggio tone production timing signal APL is generated independently of the advancement of the state of the automatic chord control device 12 (regardless of the generation timing of the signal T). Therefore, in practice, the generation timing of the signal APL is not always coincident with the generation timing of the signal T. Accordingly, the automatic arpeggio control device 13 is so designed that the signal APL is stored, and when, under the condition that the signal APL is stored, the time division operation control signal T is applied from the side of the automatic bass chord control device 12, the state for automatic arpeggio control is advanced. When the state for automatic arpeggio control reaches the final state, the storage of the aforementioned arpeggio tone production timing signal APL is cleared. The control operations in the automatic bass chord control device 12 and the automatic arpeggio control device 13 are carried out according to the high-speed clock pulse. Therefore, even if there is a slight delay between the time instant of generating the arpeggio tone production timing signal APL and the time instant of starting the operation of the automatic arpeggio control device 13, it can be substantially disregarded in auditory sense.

Figure 6:
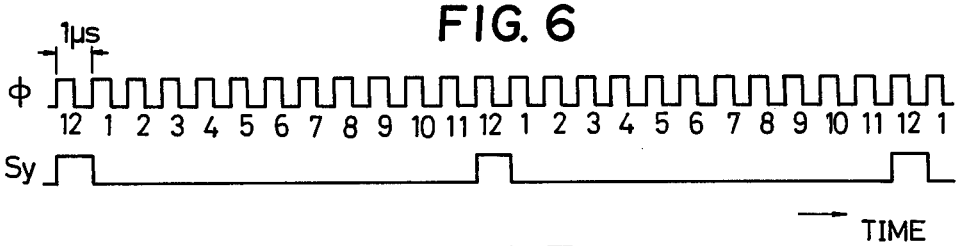
FIG. 6 is a timing chart indicating the relationships between the clock pulse $\phi$ used in the note information processing device and the state control pulse Sy employed for state-controlling in an automatic bass chord performance device and an automatic arpeggio performance device.

The state changing timing in the automatic bass chord control circuit 12 and in the automatic arpeggio control device 13 is controlled by a state control pulse Sy. This state control pulse Sy, as indicated in FIG. 6, has a period twelve times as long as that of the shifting clock pulse $\phi$ of the data register 46, and has a pulse width corresponding to one period of the pulse $\phi$.

Figure 7:
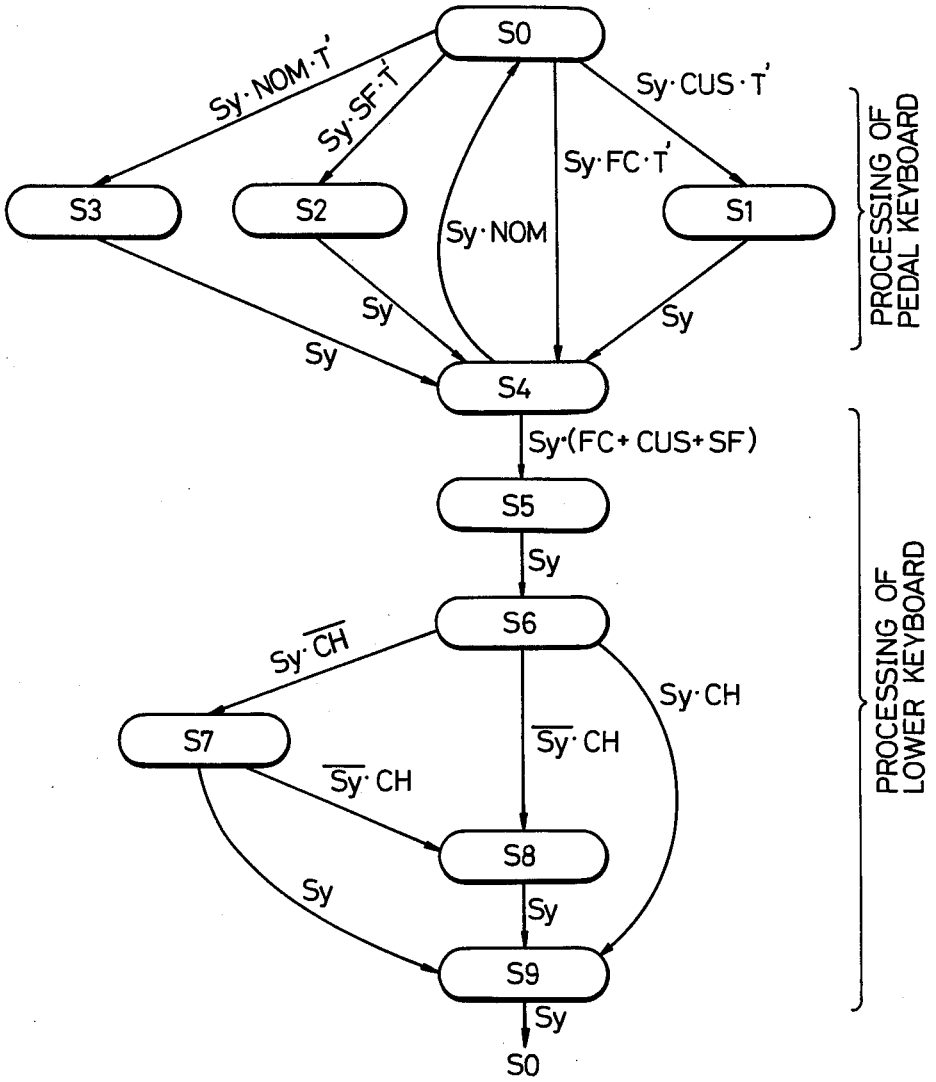
FIG. 7 is a flow chart indicating satate change conditions obtained when the note information processing device carries out the processing operations under the control of the automatic bass chord performance device shown in FIG. 1.

FIG. 7 is a flow chart indicating the state variation flow of the automatic bass chord control device 12. According to the flow chart, the control information is provided, and in the note information processing device 11 the processing operations as to the automatic bass chord performance are carried out. First of all, the processing operation as to the automatic bass chord performance will be described. In general, the processing operation as to the note information of the pedal keyboard is effected in the states S1, S2 and S3, while the processing operation as to the note information of the lower keyboard is carried out in the states S4 through S9.

In the following description, the details of the state control logic 99, the state counter 100 and the control information generating logic 101 are not illustrated; however, the logics effected in the logics 99 and 101 for every state will be indicated with logical equations. The logical equations for switching the states are included in the state control logic 99, while the logics for generating control information are included in the control information generating logic 101.

Processing in State S0

In the case of state S0, when, under the condition that the time division operation control signal T' has been applied, the state control pulse Sy is applied, the operation is advanced to the following state. Selection of the next state depends on what function has been selected for the automatic bass chord performance. When the custom function is selected, the custom function selection signal CUS is at "1". When the following logical condition is satisfied, the state is advanced to state S1.

S0·Sy·CUS·T' (→S1)

The dot (·) in the logical expression is intended to mean the logical product condition. In addition, the state number indicated with the arrow in parenthesis is intended to mean a state to which the present state is to be advanced when the logical expression is fulfilled. When the finger chord function is selected, the finger chord function selection signal FC is at "1", and when the following logical condition is satisfied, the state is advanced to state S4.

S0·Sy·FC·T' (→S4)

When the single finger function is selected, the single finger function selection signal LSF is at "1", and when the following logical condition is satisfied, the state is advance to state S2.

S0·Sy·SF·T' (→S2)

In the case where the automatic bass chord performance is not selected, the normal signal NOM is at "1", and when the following logical condition is satisfied, the state is advanced to state S3.

S0·Sy·NOM·T' (→S3)

In the state control logic 99, when the above-described logical condition for changing the state is satisfied with the timing of the state control pulse Sy, the data for changing the state is supplied to the state counter 100. In this connection, when the level of the state control puse Sy having a 1-bit time width is lowered to "0", the state counter 100 has contents representing the following state such as those described above.

Processing in State S1

For the period of time of state S1 (twelve bit time of the clock pulse $\phi$), the signal "1" is applied from the control information generating logic 101 through the control line 14 (FIG. 1) to the control lines 47*p*, 44H, 49N and 45C (FIG. 2) of the processing device 11. The key depression note data stored in the pedal keyboard note memory register 35 is selected with the aid of the signal "1" on the pedal keyboard selection control line 47P in the data selector 47, and is applied to the first priority circuit 44 through the data line $N_1$ through $N_{12}$. In the first priority circuit 44, the upper priority selection is effected on the signal "1" of the upper priority control line 44H. In this case, the data on the data lines $N_2$ through $N_{13}$ are employed as the priority information with the aid of the signal "1" on the priority information selection line 49N. Therefore, as was described with reference to FIG. 4, the first priority circuit 44 operates to select with priority the uppermost (the highest tone) note data in the data "1" on the data lines $N_1$ through $N_{12}$. Furthermore as the priority release control line 45C has the signal "1", the priority selection in the second priority circuit 45 is released. Accordingly, the output of the first priority circuit 44 is introduced through the OR circuit group 58, the data lines $M_1$–$M_{12}$, and the second priority circuit 45 to the data lines $L_1$ and $L_{12}$, while the uppermost data $N_{13}$ is also introduced to the data line $L_{13}$.

At the state control pulse Sy generation timing, the logical expression S1·Sy is satisfied, and the signal "1" is supplied to the load control line 94 of a chord register 91, whereby the data on the data lines $L_1$ through $L_{13}$ are written in the register 91. As the signal "1" on the load control in 94 is lowered to "0" when the pulse Sy has "0", the data written are stored and held in the register 91. The single note data stored in the register 91 corresponds to the root of an automatic bass tone in the custom function. Therefore, in the custom function, the highest tone in the tones of keys depressed in the pedal keyboard is selected by the first priority circuit 44, and is employed as the bass performance root. When the following logical expression is satisfied the state is advanced to S4.

S1·Sy (→S4)

Processing in State S2

In the case of the single finger function, this state S2 is obtained. If, upon generation of the state control pulse Sy, the logical expression S2·Sy is satisfied, the signal "1" is supplied to the control line 78 relating to the minor and seventh detection logic 75 for single finger shown in FIG. 2, as a result of which the AND circuits 76 and 77 are enabled, and the signal of the minor detection line 75*m* or the seventh detection line 75*s* is therefore stored in the minor chord memory 73 or the seventh chord memory 71. In this case, the signal on the load control line 74 is raised to "1" at the same time as the signal on the control line 78, so that the data can be written in the memories 71 and 73. If a white key or a black key is depressed in the pedal keyboard, the signal "1" is stored in the memory 71 or 73. However, when no key is depressed in the pedal keyboard, the storages in the memories 71 and 73 are at "0", which means the major chord.

With timing of generation of the state control pulse Sy, the following logical expression is satisfied, and the state is advanced to State S4.

S2·Sy (→4)

Processing in State S3

This State S3 is obtained when no automatic bass chord is selected. In State S3, similarly as in State S1, the signals "1" are supplied to the control lines 47P, 44H, 49N and 45C of the processing device. When the logical expression S3·Sy is satisfied with the timing of the state control pulse Sy, the signal "1" is supplied to the load control line 94 of the register 91. Accordingly, only one highest in pitch in the tones of keys depressed in the pedal keyboard is selected, and its note data is stored in the chord register 91. With the timing pulse Sy, the following logical expression is satisfied, and the state is advanced to State S4.

S3·Sy (→S4)

Processing in State S4

In this State S4, it is determined whether or not the processing as to the lower keyboard should be carried out. In the case when no automatic bass chord performance is selected, it is unnecessary to process the note information of the lower keyboard. Therefore, under the condition that the following logical expression is satisfied, the state is returned to the standby state S0, because no automatic bass chord performance is effected when the normal signal is at "1".

S4·NOM·Sy (→S0)

In this case, the tone corresponding to the note data which has been stored in State S3 is merely produced as a pedal keyboard tone.

In the case where the automatic bass chord performance has been selected, when the following logical expression is satisfied with the generation timing of the state control pulse SY, the state is advanced to State S5.

S4·Sy·(FC+CUS+SF) (→S5)

The logical sum "FC+CUS+SF" has "1" when any one of the finger chord function selection signal FC, the custom function selection signal CUS and the single finger function signal SF is at "1".

Processing in State S5

In this state S5, the signals "1" are applied to the control lines 47L, 44L and 44H of the processing device 11 (FIG. 2) by the control device 12. Withe the aid of the signal "1" on the lower keyboard selection control line 47L, and data selector 47 selects the data of the twelve notes C through B stored in the lower keyboard note memory register 36 and supplied them, in a parallel mode, to the data lines $N_1$ through $N_{12}$, respectively. Furthermore, in the first priority circuit 44 the priority release state is established when both the signals on the upper priority control line 44H and the lower priority control line 44L are raised to "1", and therefore the lower keyboard note data on the data lines $N_1$ through $N_{12}$ are passed out as they are. The lower keyboard note date are supplied through the OR circuit group 58 and the lines $M_1$ through $M_{12}$ to the data register 46. In this operation, as the signals on the control lines 45L, 45H and 45C of the second priority circuit 45 are at "0", as was described with respect to FIG. 5 the second priority circuit 45 block the passage of the data on the lines $M_1$ through $M_{12}$.

Upon provision of the state control pulse Sy, the following logic expression is satisifed.

S5·Sy (→S6)

As a result, the signal "1" is applied to the control line 61 of the data register 46, while information for shifting the state to State S6 is applied to the state counter 100. When the signal on the load control line 61 is raised to "1", the data register 46 operates to write the lower keyboard note data applied to the input lines $M_1$ through $M_{12}$ in the respective memory positions $D_1$ through $D_{12}$. In addition, the signal "1" is applied to the hold control line 62 at the same time the signal on the load control line 61 is raised to "1", as a result of which the old storage in the register 46 is released. Furthermore, when the level of the state control pulse Sy is lowered to "0", the signals on the load control line 61 and the hold control line 62 has "0". The signal "0" on the hold control line 62 is inverted to the signal "1" by the inverter, thereby to place the register in the hold state and to permit the lower keyboard note data written just now to be stored in the memory positions $D_1$ through $D_{12}$.

In consequence, in State S5, the note information stored in the lower keyboard note memory register 36 is transferred, as it is, to the data register 46. Therefore, the memory positions $D_1$ through $D_{12}$ of the data register 46 correspond to the notes C through B.

When the level of the state control pulse Sy having a 1-bit time width is lowered to "0", the contents of the state counter 100 is changed to represent the contents of State S6.

Processing in State S6

In this State S6, processing for detecting a chord composed by one through plural keys depressed in the lower keyboard is effected. For detecting a chord, the data register 46 is shifted left, and it is checked by the chord detection logic 68 (FIG. 2) whether or not a predetermined interval combination is available for every shifting operation.

First, for the period of State S6, the signals "1" are supplied to the left shift control line 63, the hold control line 62, and the left shift circulation control line 66, whereby the holding operation of the data register 46 is inhibited, and the held data is shifted, in a series mode, leftward (from $D_{12}$ toward $D_1$) with the aid of the shift clock pulse $\phi$. The inhibition of the holding operation is intended to mean the inhibition of self-holding in the memory positions $D_1$ through $D_{12}$. As the AND circuit 65 is enabled by the signal "1" of the control line 66, the output of the leftmost memory position D, is connected to the input side of the rightmost memory position $D_{12}$, and the data in the register 46 is therefore circulated. The data stored in the memory positions $D_1$ through $D_{12}$ immediately after the lower keyboard note data have been written in the data register 46 correspond to the notes C through B. When the data register 46 is shifted left, the notes of the data in the memory positions $D_1$ through $D_{12}$ are changed as indicated in Table 3 below, and are successively shifted toward the left most memory position $D_1$ starting from the data on the low tone side.

Table 3

| Shift timing | $D_1$ | $D_2$ | $D_3$ | $D_4$ | $D_5$ | $D_6$ | $D_7$ | $D_8$ | $D_9$ | $D_{10}$ | $D_{11}$ | $D_{12}$ |
|---|---|---|---|---|---|---|---|---|---|---|---|---|
| 1 | C | C# | D | D# | E | F | F# | G | G# | A | A# | B |
| 2 | C# | D | D# | E | F | F# | G | G# | A | A# | B | C |
| 3 | D | D# | E | F | F# | G | G# | A | A# | B | C | C# |
| 4 | D# | E | ..... | | | | | | | | | |
| . | . | . | | | | | | | | | | |
| . | . | . | | | | | | | | | | |
| . | . | . | | | | | | | | | | |
| Sy 12 | B | C | C# | D | D# | E | F | F# | G | G# | A | A# |

In Table 3, the numerals 1, 2, 3 . . . indicated in the column of Shift Timing indicate the timing of application of clock pulse $\phi$.

The detection operation in the chord detection logic 68 depends on the function selected for the automatic bass chord performance. In the case of the single finger function, when the logical condition S6·SF (when the single finger function selection signal is at "1" and the state is State S6) is satisfied, the signal "1" is applied to the single finger root detection control line 68R (FIG. 2). As was described before, when the signal on the control line 68R is raised to "1", the operation of the chord detection logic 68 is effected according to the logic of the logical expression (4). In the logic of the logical expression (4), the leftmost memory position $D_1$ of the data register 46 is regarded as the prime interval, and it is detected whether the data "1" is available in this memory position $D_1$. To the leftmost memory position $D_1$ of the data register 46, the data are transferred starting from the note on the low tone side. Accordingly, when the note data of the lowest tone in the tones of keys depressed in the lower keyboard is transferred to the memory position $D_1$, the logical condition (4) is established for the first time, and the signal "1" is supplied to the single tone detection line St. This signal "1" is applied to the OR circuit 69 where it becomes a chord detection signal CH which is applied to the automatic bass chord control device 12. The provision of the chord detection signal CH means that a note to be employed as the root in the single finger function is detected. In general, in the single finger function one key is depressed in the lower keyboard. However, in the case also where a plurality of keys are depressed, according to the left shifting of the aforementioned data register 46 the single tone selection corresponding to the root is carried out with the lowest tone priority.

In the case where the finger chord function or the custom function is selected, if the logical condition $S6 \cdot \overline{SF}$ (SF representing the fact that the single finger function is not selected) is satisfied, then the signal "1" is applied to the chord detection control line 68C. When the signal on the control line 68C is raised to "1" as was described before, the chord detection is carried out in the chord detection logic 68 according the above-described logical expression (1), (2) and (3). In this case, it is detected whether the chord formed by one through plural keys depressed in the lower keyboard is major, seventh or minor. If in the process in which the note employed as the root (note corresponding to the memory position $D_1$) is successively changed by the left shifting operation in the data register 46, the logical expression (1) or (2) is satisfied, the signal "1" is applied to the major chord detection line Mj or the seventh chord detection line 7th. This signal "1" is applied to the OR circuit 69 where it becomes the chord detection signal CH which is applied to the automatic bass chord control device 12. In the control information generation logic 101 in the control device 12, when the chord detection signal CH is provided at the time of State S6, the logical condition S6·CH is established, and the signal "1" is supplied to the load control line 74 of the memories 71 and 73 (FIG. 2). Accordingly, the signal on the load control line 74 is raised to "1" at the same time the chord detection signal CH is raised to "1", and the data from the OR circuits 70 and 72 are written in the seventh chord memory 71 and the minor cord memory 73. If, in this case, the chord which has established the chord detection condition in the chord detection logic 68 is a seventh chord, the signal "1" on the seventh chord detection line 7th is applied through the OR circuit 70 to the seventh chord memory 71 where it is stored; and if it is a minor chord, then the signal "1" on the minor chord detection line MIN is applied through the OR circuit 72 to the minor chord memory 73 where it is stored. In addition, when the aforementioned chord is a major chord, the storages in the memories 71 and 73 are at "0".

When the logical condition S6·CH is established, a chord establishment memory 105 (FIG. 2) is set. The state that the memory 105 is set will be represented by reference character CM.

In State S6, if the chord detection signal CH is generated before the state control pulse Sy is generated (i.e. during presence of the signal(Sy), the following logical condition is satisfied, and the state is advanced to S8.

$$S6 \cdot \overline{Sy} \cdot CH \qquad (\rightarrow S8)$$

Furthermore, in State S6, if the chord detection signal CH is provided when the state control pulse Sy is generated, then the following logical condition is satisfied, and the state is advanced to State S9.

$$S6 \cdot Sy \cdot CH \qquad (\rightarrow S9)$$

In State S6, if no chord is established even when it becomes the timing of the state control pulse Sy, the following logical condition is satisfied.

$$S6 \cdot Sy \cdot \overline{CH} \qquad (\rightarrow S7)$$

where $\overline{CH}$ means that the chord detection signal CH is at "1" In this case, a chord non-establishment memory 106 (FIG. 2) is set, and the state is advanced to State S7. The state that the memory 106 is set will be represented by reference character NCM.

As is apparent from the above description, immediately when a chord is established once, the state is advanced to State S8 or S9 from State S6, and only one chord is detected. Furthermore, as the data register 46 is shifted left, the root can be detected from the chord on the low tone side with priority.

Processing in State S7

When a named chord could not be detected in State S6, the processing in State S7 is carried out. In state S7, the lowest out of the tones of keys depressed is selected as a temporary root.

In state S7, similarly as in State S6, the signals "1" are applied tot he left shift control line 63, the hold control line 62 and the left shift circulation control line 66 of the data register 46, and the contents of the data register 46 are shifted left. In addition, the signal "1" is applied to the lowest tone detection control line 68 L of the chord detection logic 68, so as to enable the logical expression (4) described above. Accordingly, similarly as in the case of the single finger function is State S6, the signal "1" is applied to the single tone detection line St with the timing corresponding to the note of the lowest in the tones of keys being depressed, and the OR circuit 69 provides the chord detection signal CH.

When the chord detection signal CH is provided before the generation of the state control pulse Sy, the following condition is satisfied, and the state is advanced to State S8.

$$S7 \cdot CH \cdot \overline{Sy} \qquad (\rightarrow S8)$$

It should be noted that in State S7, even if the chord detection signal CH is provided, the chord establishment memory 105 is not set.

When it becomes the timing of the state control pulse without generation of the signal CH, the following logical condition is established, and the state is advanced to State S9.

$$S7 \cdot Sy \qquad (\rightarrow S9)$$

In this case, if the signal CH is provided with the timing of the state control pulse Sy, it means that only the key of the highest note B is depressed, because there is a period of time corresponding to twelve bit times between the start of State S7 and the end of State S7 with the timing of the pulse Sy, and the data of note B at the rightmost position $D_{12}$ has been moved to the leftmost position $D_1$ by the shifting operation effected during this period of time. (cf. Table 3). Furthermore, if no signal CH is provided at the timing of the pulse Sy, it means that no keys are depressed in the lower keyboard. In this case, the AND logic $S7 \cdot Sy \cdot \overline{CH}$ is established, and therefore the chord establishment memory 105, the chord non-establishment memory 106 and the chord variation memory 107 are reset. In addition, these memories 105 through 107 are so designed that they are reset by a new key-on signal NKO which is provided by the AND circuit 43 when a key is initially depressed in the lower keyboard.

Processing in S8

In this state S8, the processing is effected after the chord detection is carried out in State S6. In State S8, the control information generating logic 101 applies signals "1" to the left shift control line 63 and the hold control lines 62 of the data register 46, and the signal on the left shift circulation control line 66 is lowered to "0". Therefore, the data register 46 merely shifts its data left; that is, the data at the leftmost position $D_1$ is not applied to the rightmost position $D_{12}$, and the signal "0" is written in this rightmost position $D_{12}$ every shifting operation. By this processing, the contents of the data register 46 will become as follows: That is, when the chord detection signal CH is produced in State S6 or S7, the note data corresponding to the root of the chord is held in the memory position $D_1$ corresponding to the prime interval. In this case, the output of the memory position $D_1$ is connected through the AND circuit 65 to the input side of the memory position $D_{12}$, and upon application of the next clock pulse $\phi$ (after one bit time) the note data corresponding to the aforementioned root is written in the right-most memory position $D_{12}$. At the same time, the state is changed to State S8. Accordingly, at the first bit time in State S8, the rightmost memory position $D_{12}$ has the note data corresponding to the root. Thereafter, the contents of the data register 46 are shifted left with the timing of the clock pulse $\phi$, and the data "0" is written in the rightmost memory position $D_{12}$ because the AND circuit 65 is disabled. Therefore, the aforementioned note data is shifted to a memory position leftward (downward) of the memory position $D_{12}$, and all the data in the memory positions rightward (upward) of that memory position are lowered to "0". That is, is State S8, the note data corresponding to the root will have the signal "1" data in the uppermost position (closest to the position $D_{12}$) in the data register 46.

With the timing of generation of the state control pulse Sy, the following logical condition is established, and the state is advanced to State S9.

$$S8 \cdot Sy \qquad (\rightarrow S9)$$

When the state is changed from State S6 to State S8 as was described above, no state control pulse Sy is provided. That is, during the period of time of twelve bit times from the time instant when the state is changed from State S5 to State S6 with the timing of generation of the state control pulse Sy to the time instant when the next state control pulse Sy is generated, States S6 and S8 are passed. Furthermore, as for the notes of the data in the memory positions $D_1$ through $D_{12}$ of the data register 46, the leftmost memory position $D_1$ corresponds to note B while the positions $D_2$ through $D_{12}$ correspond to notes C through A# at the timing of generation of the state control pulse Sy, as indicated in Table 3. Accordingly, when State S9 is obtained one bit time after the timing the condition $S8 \cdot Sy$ is established, the contents of the data register 46 are shifted as much as one shift, and therefore the memory positions $D_1$ through $D_{12}$ are allowed to correspond to notes C through B as indicated in the shift timing 1 tof Table 3. In the aforementioned State S6 or S7, when the signal CH is produced at the timing of the state control pulse Sy, the state is changed to State S9 without passing through State S8 because at the time instant the same state as that obtained at the end of State S8 is provided.

Figure 8:
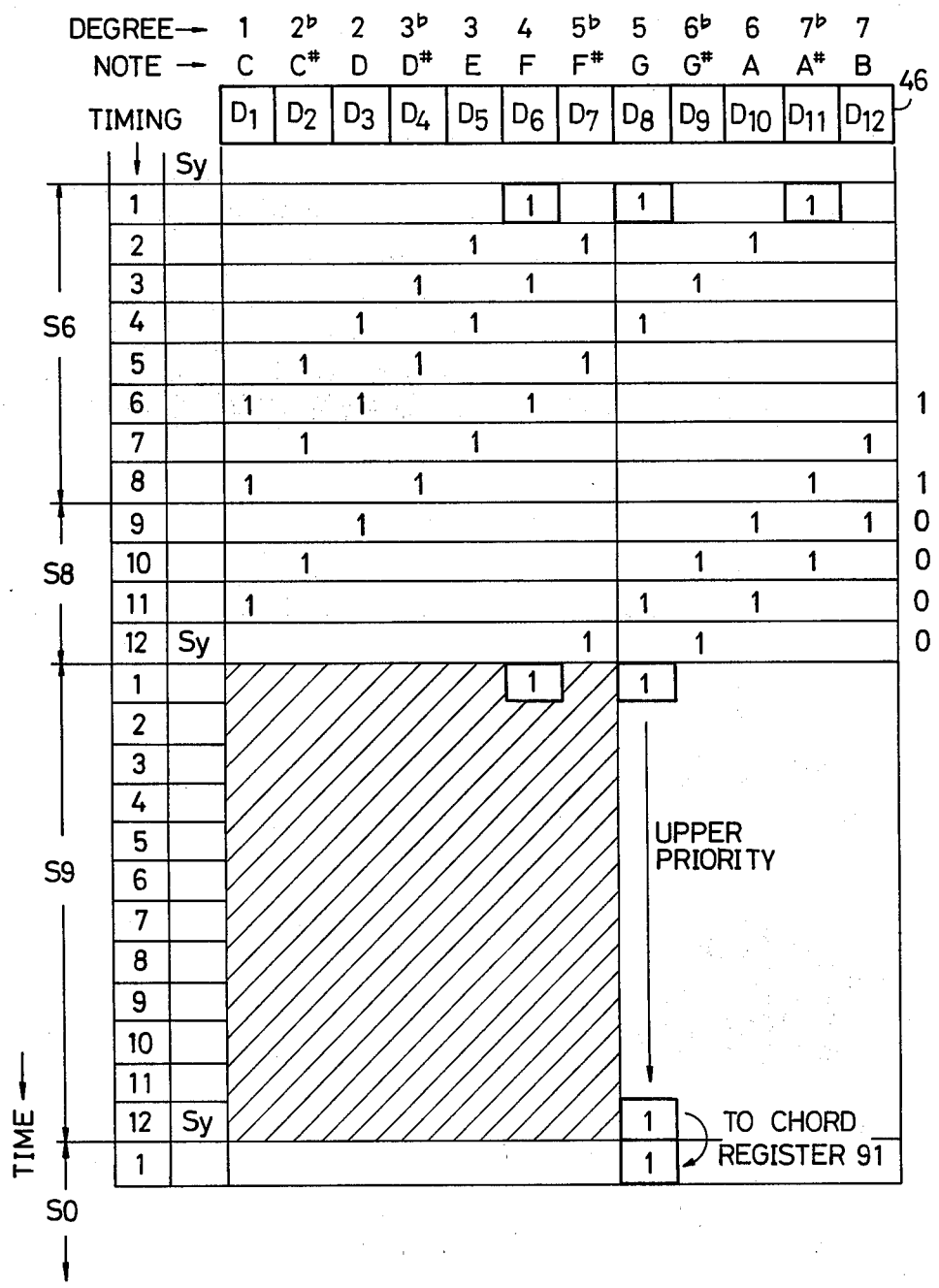
FIG. 8 is an explanatory diagram showing one concrete example of the processing operations of the note information processing device in States S6, S8 and S9 indicated in FIG. 7; more specifically, signal conditions in the memory positions $D_1$ through $D_{12}$ of a data register being indicated in the columns of States S6 and S8, a state of selecting root data by upper priority being indicated in the column of State S9.

FIG. 8 shows one example of the process passing through State S8, and in this case a G minor seventh chord is designated by depressing the keys of three notes F, G and A# in the lower keyboard. First, at the first timing 1 of State S6, the signals "1" are provided in the memory positions $D_6$ $D_8$ and $D_{11}$ of the data register 46 corresponding to notes F, G and A#, respectively. As the timing in successively advanced according to the shift clock pulse $\phi$, the data "1" in the data register 46 is successively shifted left. In State S6, the data in the leftmost position $D_1$ is written in the rightmost memory position $D_{12}$. Therefore, the data "1" of the position $D_1$ at the timing 6 of State S6 is written in the position $D_{12}$ at the timing 7. At the timing 8 of State S6, the G note data, the A# note data, and the F note data are provided in the positions $D_1$, $D_4$ and $D_{11}$, respectively. As is apparent from the relationships between the memory positions $D_1$ through $D_{12}$ and the note degrees 1, 2, . . . 7 indicated in Table 2, at the timing 8 the data of the position $D_1$ of the prime is at "1", the data of the position $D_{11}$ of the minor seventh degree is at "1", and the data of the positions $D_3$, $D_6$ and $D_{10}$ corresponding respectively to the second, fourth and sixth degrees are at "0", and furthermore the seventh chord detection condition, or the logical expression (2) $1 \cdot \overline{2} \cdot \overline{4} \cdot \overline{6} \cdot 7\flat$ is established. Accordingly, at the timing 8 of State S6, the chord detection signal CH is produced. In this case, the data "1" is provided in the memory position $D_4$ corresponding to the minor third degree, and therefore the logical expression (3) described before is established, as a result of which the signals on both of the seventh chord detection line 7th and the minor chord detection line MIN are raised to "1". Thus, it is detected that the type of chord is a minor seventh.

If a chord is established at the timing 8, State S8 is obtained immediately at the next timing 9. At the first timing 9 of State S8, the data "1" of note G corresponding to the root provided in the leftmost memory position $D_1$ at the last timing 8 of State S6 has been shifted to the rightmost memory position $D_{12}$. In State S8 the signal "0" is written in the rightmost memory position $D_{12}$. Therefore, even if the data "1" is provided in the position $D_1$ at the timing 11 of State S8, the data in the position $D_{12}$ is maintained at "0" at the next timing. Thus, in State S8, the note data corresponding to the root at the uppermost position (the high tone side) of the data register 46 is raised to "1". Then, at the timing 12 (or the timing of the state control pulse Sy) of State S8, the last left shifting' operation is carried out, and at the first timing 1 of the next State S9, the signals "1" are stored in the memory positions $D_6$ and $D_9$. As is apparent from FIG. 8, just twelve bit times have passed for the period of time of from the first timing 1 of State S6 to the first timing 1 of State S9. During this period, the data of the memory positions $D_1$ through $D_{12}$ of the data register 46 are shifted left, and the relationships between the memory positions and the notes are returned to the initial ones. More specifically, the G note data "1" is provided in the memory position $D_8$, and the F note data "1" is provided in the memory position $D_6$. However, the A# note date higher in pitch than the note G which is the root is cancelled by the processing in State S8. Under this condition, the processing in State S9 is carried out as described later.

In the processing through State S7, just twenty-four bit times have passed from the first timing 1 of State S6 to the first timing 1 of State S9, and therefore the relationships of the memory positions $D_1$ through $D_{12}$ with respect to the notes are restored as before. In addition, when a chord is detected at the last timing 12 (or the timing of the state control pulse Sy), the root tone is note B (cf. Table 3), and it is shifted to the note B's original position $D_{12}$ at a next timing, and therefore State S8 is unnecessary.

Processing in State S9

In this state S9, the data corresponding to the root of the chord detected in the aforementioned State S6 or the temporary root detected in State S7 is stored in the chord register 91. In State S9, the signal on the left shift control line 63 is lowered to "0", and the shifting operation of the data register 46 is suspended. In addition, as the signal on the hold control line 62 is at "0", the data register 46 is placed in hold state. In this case, the memory positions $D_1$ through $D_{12}$ in the data register 46 correspond to note C through B, and the data of the note corresonding to the root has "1" by the processing of the aforementioned S8, and under this condition the contents of the data register 46 are maintained unchanged.

In State S9, the signal "1" is applied to the data selection control line 47D of the data selector 47, and the data in the memory positions $D_1$ through $D_{12}$ of the data register 46 are selected by the selector 47 so as to be applied to the data lines $N_1$ through $N_{12}$. At the same time, the signals "1" are applied to the upper priority control line 44H and the lower priority control line 44L of the first priority circuit 44 to release the priority of the priority circuit 44, and the signal "1" is applied to the upper priority control line 45H of the second priority circuit 45 to place the second priority circuit 45 in upper priority state. Accordingly, the data in the memory positions $D_1$ through $D_{12}$ of the data register 46 are passed through the first priority circuit 44 after passing through the data lines $N_1$ through $N_{12}$ ($D_1$ corresponding to $N_1$, $N_2$ through $D_{12}$ corresponding $N_2$ through $N_{12}$, respectively), and are introduced to the lines $M_1$ through $M_{12}$ through the OR circuit group 58, as a result of which the uppermost (highest in pitch) data "1" is selected in the second priority circuit 45. As the uppermost data "1" has become the note data of the root by the processing in the State S8, the signal only on the line corresponding to the root in the output lines $L_1$ through $L_{12}$ of the second priority circuit 45 is raised to "1". In the above description, the first priority circuit 44 is placed in priority release state, while the second priority circuit 45 is placed in upper priority state; however, it is possible to place the circuit 44 and 45 in upper priority state and in priority release state, respectively.

The data on the lines $L_1$ through $L_{12}$ are applied to the coincidence detection circuit 90, in which the contents of the data on the lines $L_1$ through $L_{12}$ are compared with the contents of the memory output lines $R_1$ through $R_{12}$ of the chord register 91, and when both are coincidence with each other, the coincidence detection signal COIN is raised to "1", while when not coincident, the signal COIN is lowered to "0". The root data of the chord detected in the previous state cycle (the processing in States SO through S9) is stored in the chord register 91. Therefore, when the chord composed by depressing keys in the lower keyboard is changed, the data of the lines $L_1$ through $L_1$ obtained by the present state processing will not coincide with the data of the lines $R_1$ through $R_{12}$ obtained by the preceding state processing. If the following logical condition is established in the case of non-coincidence, a chord change memory 107 (FIG. 2) is set.

$$S9 \cdot Sy \cdot \overline{COIN} \cdot BT \cdot \overline{CUS} \cdot (\overline{CM \cdot NCM})$$

where $\overline{COIN}$ indicates that the coincidence detection signal COIN is at "0", BT indicates the timing of the production any of the bass tones of the necessary degrees, $\overline{CUS}$ indicates that the custom function is not selected, and $\overline{CM \cdot NCM}$ indicates that none of the chord establishment memory 105 and the chord non-establishment memory 106 are set. For instance, if three keys are depressed to establish a chord (the chord establishment memory 105 is set, and CM is raised to "1") and then the chord is decomposed by releasing one or two keys in the three keys (the chord non-establishment memory 106 is set, and NCM is raised to "1"), then both CM and NCM are raised to "1"; that is, the condition CN·NCM is satisfied. Accordingly, $\overline{CM \cdot NCM}$ means that the condition CM·NCM is not satisfied. The reason for this is as follows: Sometimes the condition CM·NCM is satisfied by fluctuation in key depression pressure or in key release timing, which is not desired by the performer; however, the circuitry is so designed that in such a case the chord change is not admitted. Furthermore, the signal BT representing the timing of production of a bass tone is included in the condition for preventing a bass tone which is being produced from being affected by detection of the chord change during the production of the bass tone. For this purpose, the chord change should be detected only at the timing of producing an automatic bass tone. It is included in the condition that the custom function is not selected, because in the custom function the lower keyboard is used only for detecting the kind of chord, and as described with respect to the processing in State S1 the root of a bass tone is specified by operating the pedal keyboard and is not related to a chord of the lower keyboard. When the aforementioned logical condition is satisfied with the state control pulse Sy generation timing, it is admitted that the chord has changed, and the chord change memory 107 is set. The state that the chord change memory 107 is set will be indicated by reference character CC. The set output CC of the chord change memory 107 is utilized for controlling the interval of a bass tone in a bass tone source section 98 (FIG. 1). More specifically, when the chord change memory 107 is set, the bass tone source section 98 cancels the interval which is specified by the bass pattern information BP, and produces the root tone. Thus, by producing the root tone the root of a new chord after change) at the time of chord change, the chord change is impressed. The storage in the chord change memory 107 is reset when the next bass tone production timing signal BT is applied thereto. Therefore, only one tone, or the root, is forcibly prodcuced at the time of chord change, and thereafter the degree of the bass pattern information BP is followed. The bass tone production timing signal BT is of the timing component of the bass pattern information BP. The signal BT can be obtained by applying the bass pattern information BP including the degree and timing component to an OR circuit (not shown) for instance.

The condition for writing the root note data of the lines $L_1$ through $L_{12}$ in the chord register 91 in State S9 is as follows:

$$S9 \cdot Sy \cdot BT \cdot \overline{CUS} \cdot (CM \cdot \overline{NCM} + \overline{CM} \cdot NCM)$$

The meanings of the signals BT and $\overline{CUS}$ and the reason for adding them in the condition are the same as those described with respect to the chord change detection condition. That is, writing a new data in the register 91 is changing the note of the root, and therefore the writing the new data is effected at the timing of production of the bass tone. In the case of the custom function, the root data of the bass tone at the time of State S1 has been written in the register. The EXCLUSIVE OR logic "$CM \cdot \overline{NCM} + \overline{CM} \cdot NCM$" between the contents CM of the chord establishment memory 105 and the contents NCM of the chord non-establishment memory 106 is satisfied when only one of the memories 105 and 106 is set. In other words, when the state of the memories 105 and 106 is of CM·NCM or $\overline{CM} \cdot \overline{NCM}$, the condition for writing data in the register 91 is not satisfied. As was described before, the condition CM·NCM is established when some of the keys being depressed are changed, and it does not work (writing data in the register 91 is not effected) for the fluctuation of key depression pressure or key operation timing which is not desired by the performer. The condition $\overline{CM} \cdot \overline{NCM}$ represents that no key is depressed. That is, when the chord detection signal CH representing the temporary root is not produced in State S7, the chord establishment memory 105, the chord non-establishment memory 106, and the chord change memory 107 are reset. As a result, the condition CM·NCM representing that both of the memories 105 and 106 are in reset state is satisfied. Accordingly, in the case when all the keys are released in the lower keyboard, writing data in the chord register 91 is not carried out. Thus, even after key release, the note data corresponding to the root provided at the time of key depression is stored in the chord register 91. Even if the root note is stored in the chord register 91, no trouble is caused, because if the output, or key depression signal LKM, of the lower keyboard key depression memory 41 is lowered to "0", no bass tone is produced in the bass tone source section 98 and no chord tone is produced in the chord tone source section 97.

Thus, in the case when keys are newly depressed in the lower keyboard, the chord establishment memory 105 and chord non-establishment memory 106 are reset by the new key-on signal NKO, and thereafter one of the memories 105 and 106 is set, then the EXCLUSIVE OR condition (CM·NCM+CM NCM) is satisfied. In this connection, when the aforementioned logical condition for the writing operation of the chord register 91 is established with the timing of the state control pulse Sy in State S9, the signal "1" is supplied to the load control line of the chord register 91, and the root note data supplied through the output lines $L_1$ through $L_{12}$ of the second priority circuit 45 is written in the chord register 91.

When it becomes the timing of the state control pulse Sy, the following logical condition is established in the state control logic 99, and the state is changed to State SO, or the standby state:

$$S9 \cdot Sy \qquad (\rightarrow S0)$$

When the standby state SO is obtained in one bit time, the condition S9·Sy is not established, and the signal of the load control line 94 is lowered to "0". Accordingly, the signal "1" is applied to the hold control input of the chord register 91 through the inverter from the line 94, and the root note data written immediately before is stored and held in the board register 91. In the case of FIG. 8, the data "1" of note G is stored in the chord register 91.

In state S9, the root note data is written in the chord register 91 only when the finger chord function or the single finger function is selected. In the case of the custom function, one key depression data of the pedal keyboard is written in the chord register 91 in State S1, and when the automatic bass chord is not effected, one key depression data is written in the chord register 91 in State S3. In the case where the single finger cunction is selected, the single finger function selection signal SF applied to the control line 96 is at "1". Therefore, the single finger gate 95 is enabled at all times, and a single root note data stored in the chord register 91 is introduced through the lines $R_1$ through $R_{12}$ to the output lines $R_1'$ through $R_{12}'$ of the gate 95 and is supplied to the single finger chrod tone source section 97 (FIG. 1).

The data on the lines $R_1'$ through $R_{12}'$ which are applied to the single finger chord tone source section 97 correspond to the twelve C through B, and only one line in the lines $R_1'$ through $R_{12}'$ corresponding to the note of the root stored in the chord register 91 has the signal "1". The single finger chord tone source section 97 operates to generate a tone source signal having a frequency corresponding to the root note applied through the lines $R_1'$ through $R_{12}'$ to automatically form a tone (subtone) which is in a predetermined note interval relation to the root, and to generate a tone source signal having a frequency corresponding to the subtone note. These tone source signals of the root and subtone are simultaneously selected and mixed with the timing of the chord tone production timing signal CG, and are then applied to a filter 108 (FIG. 1) for coloring a chord tone. In the single finger tone source section 97, the subtone degree is determined by the presence or absence of the seventh signal $CH_7$ and minor signal CHm which are the memory output of the seventh chord memory 71 and the minor chord memory 73 (FIG. 2). When both of the seventh signal $CH_7$ and the minor signal $CH_m$ are at "0", it means a major chord. Therefore, for instance, the tones of notes having intervals of major third and perfect fifth with respect to the root note are produced, and three tones of prime, (root), major third and perfect fifth are employed as a chord tone. When only the minor signal CHm is at "1", the tones of notes having intervals of minor third and perfect fifth with respect to the root note are produced, so that three tones of prime (root,) minor third and perfect fifth are employed as a chord tone. Furthermore, when only the seventh signal $CH_7$ is at "1", three tones having degrees of prime (root), major third, and minor seventh are produced with respect to the root note so as to be employed as a chord tone. When both of the seventh signal $CH_7$ and the minor signal $CH_m$ are at "1", three tones having degrees of prime (root), minor third, and minor seventh are produced with respect to the root note. If the tone generators in the single finger tone source section 97, the bass tone source section 98 and the arpeggio tone source section 93 are made up of digital type variable frequency division circuits, respectively, it is advantageous in fabricating the automatic performance section 10 in the form of an integrated cicuit.

The data stored in the chord register 91 are applied to the bass tone source section 98 through the lines $R_1$ through $R_{13}$. As was described before, the lines $R_1$ through $R_{12}$ correspond to the notes C through B. In the case of the finger chord function or the single finger function, only the lines $R_1$ through $R_{12}$ are used, and the signal on the line $R_{13}$ is kept at "0" at all times. The line $R_{13}$ corresponds to the highest tone C' (which is note $C_2$, in practice) of the pedal keyboard, and when the custom function and the automatic bass chord performance are not effected, the data of the lines $R_1$ through $R_{13}$ are effective. Upon application of the bass pattern information BP representing a degree at certain timing, the bass tone source section 98 provides the tone source signal of a note having the aforemention degree with respect to the root note represented by the data on the lines $R_1$–$R_{13}$, and the tone source signal thus provided is applied to a filter 109 for coloring bass tones. The outputs $CH_7$ and CHm of the seventh chord memory 71 and the minor chord memory 73 are utilized for modifying the degree. In the case where the minor signal CHm is at "1", if the bass pattern information BP designates a major third interval, it is changed to the tone of minor third degree. Furthermore, in the case where the seventh signal $CH_7$ is at "1", it is changed to the tone of minor seventh degree when the stone of major seventh degree should be produced.

Figure 9:
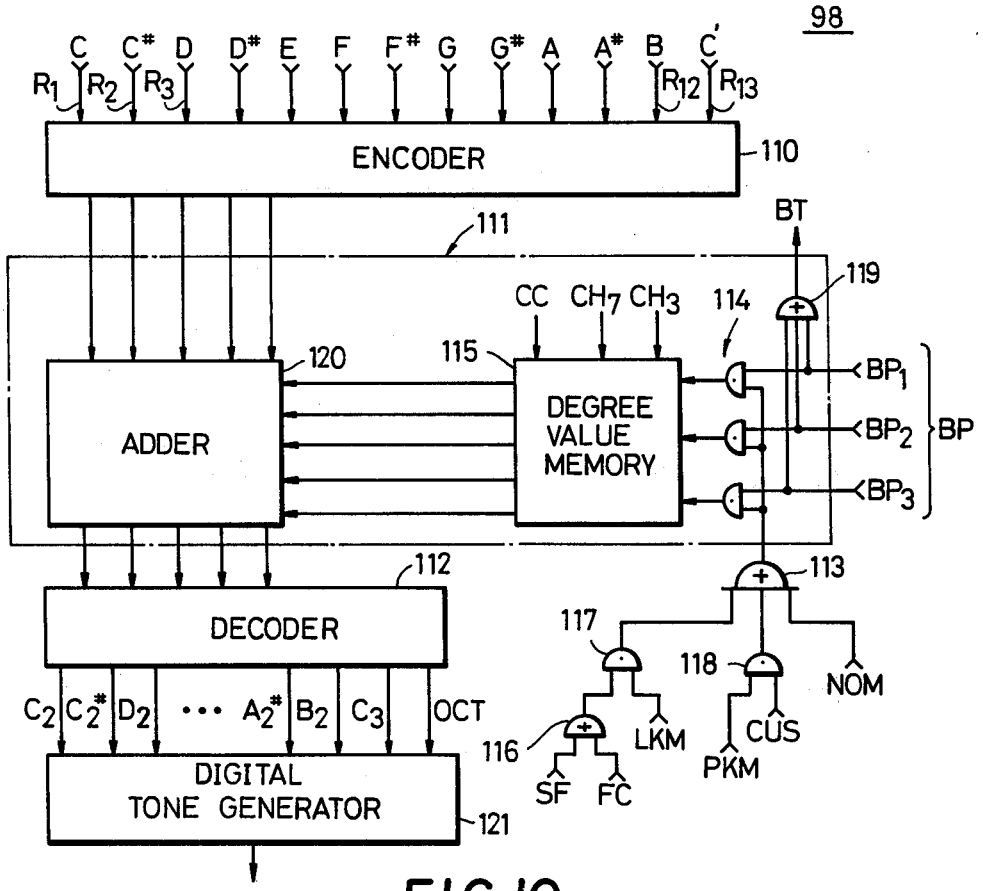
FIG. 9 is a block diagram showing one example of a bass tone source section shown in FIG. 1.

FIG. 9 is a block diagram illustrating one example of the bass tone source section 98. The specific features of this circuit are as follows: The data of the thirteen input lines $R_1$ through $R_{13}$ corresponding respectively to the notes C through B and C' are converted into 5-bit numerical data in an encoder 110. The numerical data corresponding to the root note outputted by the encoder 110 is subjected to calculation according to the degrees represented by the bass pattern information BP in a calculation section 111 for calculating numerical data corresponding to a note having the degree with respect to the root note, and the numerical data thus calculated is decoded by a decoder 112 separately according to the notes. The bass pattern information BP can provide a progressions of the degrees such as prime, third, fifth sixth, seventh and eighth degrees. However, in general, in order to form note data having such various degrees for each of the notes C through B, it is necessary to provide read-only memories or the like, which leads necessarily to intricate circuitry. However, as is apparent from FIG. 9, individual note data are converted into numerical data, and thereafter the numerical data of notes having predetermined degree are calculated. Thereafter, these numerical data are converted into the individual note data so as to be utilized. Accordingly, the circuitry can be simplified if the arrangement shown in FIG. 9 is employed.

Referring to FIG. 9, the bass pattern information BP consists of a 3-bit data $BP_1$, $BP_2$, $BP_3$, and sevens states 001–111 of the data $BP_1$–$BP_3$ correspond respectively to seven degrees of prime, third, fifth, sixth, minor seventh, major seventh and eighth (one octave). In the calculation section 111, upon application of the signal "1" by the OR circuit 113, an AND circuit group 114 is enabled, and the bass pattern information $BP_1$–$BP_3$ is applied to a degree value memory 115. When the single finger function section signal SF or the finger chord selection signal FC is at "1", the signal "1" is applied to an AND circuit 117 through an OR circuit 116. If in this case the output LKM of the lower keyboard key depression memory 41 described before is at "1", the output "1" of the AND circuit 117 is applied to the OR circuit 113 as a result of which the AND circuit group 114 is enabled. When the custom function selection signal CUS is at "1", an AND circuit 118 is enabled, and when the output PKM of the pedal keyboard key depression memory 40 described before is at "1", the signal "1" is applied to the OR circuit 113 by the AND circuit 118. Furthermore, when no bass chord performance is effected, the normal signal NOM is at "1", and is applied to the OR circuit 113. In this example, the bass pattern information $BP_1$–$BP_3$ is selected even by the normal signal NOM; however, when the normal signal NOM is at "1", the output of the encoder 110 may be applied, as it is, to the decoder 112. The bits $BP_1$–$BP_3$ of the bass pattern information are applied to an OR circuit 119, as a result of which the bass tone production timing signal BT is produced.

In the degree value memory 115, the degree information represented by the bass pattern information $BP_1$–$BP_3$ is converted into a value suitable for calculation in the adder 120, and the value thus obtained is outputted. In this case, when the minor signal CHm is at "1", a numerical data corresponding to a minor third degree is outputted in correspondence to the bass pattern information $BP_1$–$BP_3$ of third degree, and when the seventh signal $CH_7$ is at "1", a numerical data corresponding to a minor seventh degree is outputted in correspondence to the bass pattern information $BP_1$–$BP_3$ of major seventh degree. When the set output CC of the chord change memory 107 (FIG. 2) is at "1", a numerical data corresponding to a prime or eighth degree is forcibly outputted. In the adder 120, a numerical data corresponding to a predetermined degree supplied by the degree value memory 115 is added to a numerical data corresponding to a root note supplied by the encoder 110, and a numerical data corresponding to a note having the predetermined degree with respect to the root note is outputted. The decoder 112 operates to convert the numerical data outputted by the adder 120 into a note corresponding to that numerical data. The decoder 112 has fourteen output lines. In the fourteen output lines, thirteen output lines correspond to the actual notes $C_1$ through $B_1$ and $C_2$ in the pedal keyboard, and the remaining one designates an octave (OCT). When the signal "1" is provided on the output line corresponding one of the notes $C_1$ through $C_2$ and the signal "1" is provided on the octave line OCT, it indicates that a tone higher by one octave should be produced. The output of the decoder 112 is applied to a digital tone generator 121, and the tone source signal of the tone represented by the decode output is produced. The output of the digital tone generator 121 is applied to the filter 109 (FIG. 1) through a circuit for giving an amplitude envelope (not shown).

The processing operation in the note information processing circuit 11 is shifted to the standby state SO upon completion of the last State S9, and as long as interruption by the automatic arpeggio control device 13 is not effected, the processing operations from State SO to State S9 (to State S4 when the automatic bass chord performance is not selected) is repeated under the control of the automatic bass chord control device 12. In the case where the automatic bass chord performance is selected, if the logical condition S9·Sy is satisfied with the timing of the state control pulse Sy in State S9, the time division operation control signal T is supplied toward the automatic arpeggio control device 13. In the case where the automatic bass chord performance is not selected, the normal signal NOM is at "1" and when the condition S4·Sy·NOM is satisfied in State S4, the time division operation control signal T is produced. Accordingly, the time division operation control signal T applied to the automatic arpeggio control device 13 from the side of the automatic bass chord control device 12 is produced for one bit time at the end of the last State S9 (or S4).

Figure 10:
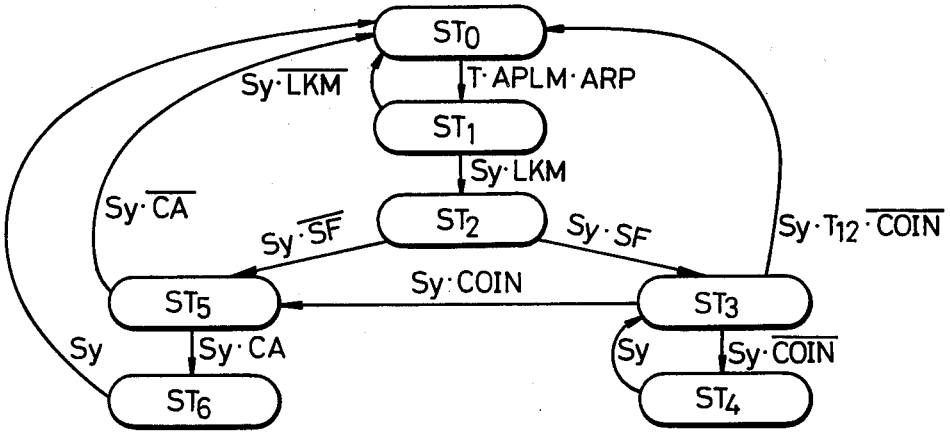
FIG. 10 is a flow chart indicating state change conditions obtained when the note information processing device carries out the processing operations under the control for the automatic arpeggio performance device shown in FIG. 1.

Shown in FIG. 10 is a flow chart showing the state change in the automatic arpeggio control device 13. According to this flow chart, control information is provided by the automatic arpeggio control device 13, and the various processing operations are carried out in the note information processing device 11. As was described before, the automatic arpeggio control device 13 operates only when the arpeggio tone production timing control section 21 provides the arpeggio tone production timing signal APL. For this purpose, an arpeggio tone production timing memory 122 (FIG. 1) is provided in the automatic arpeggio control device 13. Upon application of the arpeggio tone production timing signal APL, the memory 122 is set.

Processing in State $ST_0$

In this standby State $ST_0$, the time division operation control signal T' is produced at all times to especially enable the automatic bass chord control device 12. When the following AND condition is established in this State $ST_0$, data for shifting the processing operation to the next State $ST_1$ is applied to the state counter 103 by the state control logic 102, and one bit time later the state counter 103 has contents representing State $ST_1$.

$$ST_0 \cdot T \cdot APLM \cdot ARP \qquad (\rightarrow ST_1)$$

As long as the above-described condition is not established, the standby state $ST_0$ is maintained. With the aforementioned AND condition, when the above-described memory 122 is set by the arpeggio tone production timing signal APL, the arpeggio tone production timing signal APLM is raised to "1". The arpeggio selection signal ARP is applied by the arpeggio selector 20, and when the automatic arpeggio performance is selected, it is raised to "1". Only in the case where the arpeggio tone production timing memory 122 is set when the time division operation control signal T is supplied by the automatic bass chord control device 12, the processing operation is shifted to State $ST_1$.

Processing in State $ST_1$

In this state, it is checked whether or not keys are depressed in the lower keyboard for automatic arpeggio performance. When the processing operation is changed from State $ST_0$ to State $ST_1$, the time division operation control signal T' is eliminated. The elimination of the signal T' is one bit time after the production of the time division operation control signal T described before. In this case, the state of the automatic bass chord control device 12 is changed to the standby state SO. However, since the signal T' is eliminated when the state of the automatic arpeggio control device is changed to $ST_1$, the automatic bass chord control device 12 maintains the standby State SO. Accordingly, in State $ST_1$, the note information processing device 11 is under the control of the automatic arpeggio control device 13.

In the case where keys are depressed in the lower keyboard, the lower keyboard key depression memory signal LKM outputted by the lower keyboard key depression memory 41 is raised to "1". Accordingly, if the following logical condition is established with the timing of the state control pulse Sy, the next State $ST_2$ is obtained.

$$ST_1 \cdot Sy \cdot LKM \qquad (\rightarrow ST_2)$$

when keys are not depressed, the key depression memory signal LKM is at "0". In this case, the following condition is established and the state is returned to the standby state $ST_0$.

$$ST_1 \cdot Sy \cdot LKM \qquad (\rightarrow ST_0)$$

Only when keys are depressed in the lower keyboard, the state is advanced to the next State $ST_2$.

Processing in State $ST_2$

In this State $ST_2$, it is discriminated whether the arpeggio is a "chord arpeggio" or a normal "automatic arpeggio" (hereinafter referred to as "a normal arpeggio" when applicable). The "chord arpeggio" is an automatic arpeggio performance effected when the single finger function is selected for automatic bass chord performance, and a plurality of automatic arpeggio tones are formed by using the chord detected in the processing for automatic bass chord (that is, the information representing the root data stored in the chord register 91 and the type of chord stored in the seventh chord memory 71 and the minor chord memory 73), the tones thus formed being successively produced in arpeggio system. With the "normal arpeggio", the arpeggio performance is effected by using only the note information concerning a key which is being depressed in the lower keyboard. In the case of the chord arpeggio, the single finger function selection signal SF is at "1", and the following condition is established at the production of the state control pulse Sy, as a result of which the state is shifted to State $ST_3$.

$$ST_2 \cdot Sy \cdot SF \qquad (\rightarrow ST_3)$$

At the same time, the signals "1" are applied to the control lines 61 and 62 of the data register 46 of the note information processing device 11 and to the control line 123 of a chord arpeggio subtone data forming logic 59 (FIG. 2) by the control information generating logic 104 (FIG. 1). This logic 59 operates to provide subtone degree data in response to the seventh signal $CH_7$ and the minor signal CHm supplied respectively by the seventh chord memory 71 and the minor chord memory 73. Upon application of the signal "1" to the control line 123, the logic 104 outputs of the subtone interval data, which is applied through the OR circuit group 58 to the data register 46. In this operation, the signals on the load control line 61 and the hold control line 62 of the data register 46 are raised to "1", and therefore the hold state of the data register 46 is released, and the subtone degree data supplied by the chord arpeggio subtone data forming logic 59 is newly written in the data register 46.

The correspondence relationships between the degrees and the memory positions $D_1$ through $D_{12}$ in the data register 46 ate are as indicated in Table 2 described before. The degrees of subtone data provided by the chord arpeggio subtone data forming logic 59 are as follows:

First of all, when both of the seventh signal $CH_7$ and the minor signal $CH_m$ are at "0", it means the "major chord". Therefore, subtone data corresponding the following three degrees are produced, and the signals "1" are written in the memory positions $D_1$, $D_5$ and $D_8$ of the data register 46.

Prime, major third, and perfect fifth.

When the seventh signal $CH_7$ is at "1" while the minor signal CHm is at "0", it means the "seventh chord". Therefore, subtone data corresponding to the following four degrees are produced, and the signals "1" are written in the memory positions $D_1$, $D_5$, $D_8$ and $D_{11}$ of the data register 46.

Prime, major third, perfect fifth and minor seventh.

When both of the seventh signal $CH_7$ and the minor signal $CH_m$ are at "1", it means the "minor seventh chord". Therefore, subtone data corresponding to the following four degrees are produced, and the signals "1" are written in the memory positions $D_1$, $D_4$, $D_8$ and $D_{11}$ of the data register 46.

Prime, minor third, perfect fifth, and minor seventh

When the seventh signal $CH_7$ is at "0" while the minor signal CHm is at "1", it means the "minor chord". Therefore, subtone data corresponding to the following three degrees are produced, and the signals "1" are written in the memory positions $D_1$, $D_4$ and $D_8$ of the data register 46.

Prime, minor third, and perfect fifth

In the case when the above-described condition $ST_2 \cdot Sy \cdot SF$ is established, the above-described processing is carried out, and in addition a counter 124 (FIG. 1) for providing priority information $T_1$ through $T_{12}$ is reset.

In the case of the normal arpeggio, the single finger function selection signal SF is at "0", and the following condition is satisfied at the time of production of the state control pulse Sy, as a result of which the state is shifted to State $ST_5$.

$$ST_2 \cdot Sy \cdot SF \qquad (\rightarrow ST_5)$$

Processing in State $ST_3$

This State $ST_3$ and the next State $ST_4$ are to be effected in the case of the "chord arpeggio". In States $ST_3$ and $ST_4$, the subtone degree data written in the data register 46 in State $ST_2$ is shifted right, and the position of the root (prime interval) data is allowed to coincide with the position of the root note stored in the chord register 91.

When the contents of the state counter 103 have a value representing State $ST_3$, the control information generating logic 104 supplies the signals "1" to the control line 47D of the data selector 47, the control line 49T of the priority information select gate 48, the upper priority control line 44H of the first priority circuit 44 and the lower priority control line 45L of the second priority circuit 45. As a result, in the data selector 47 the data in the memory positions $D_1$ through $D_{12}$ are selected and are then applied through the lines $N_1$ through $N_{12}$ to the first priority circuit 44, and in the first priority circuit 44 the data $T_1$ through $T_{12}$ are employed as priority information, and the input data $N_1$ and $N_{12}$ are selected with upper priority. The data selected with upper priority are introduced through the OR circuit group 58 to the data lines $M_1$ through $M_{12}$ and are employed as the input data of the second priority circuit 45. In the second priority circuit 45, a sig ingle data "1" is selected with lower priority with the aid of the signal "1" on the control line 45L, and the data thus selected is applied to the coincidence detection circuit 90 through the lines $L_1$ through $L_{12}$. The coincidence detection circuit 90 operates to compare the data of the lines $L_1$ through $L_{12}$ with the contents of the chord register 91. In the chord register 91 the root note data detected in the processing for automatic bass chord has been stored. In the upper priority in the first priority circuit 44 all data which are higher than the priority data $T_1$ through $T_{12}$ are selected. In the lower priority in the second priority circuit 45, only one data, that is, the lowest data "1", is selected. Accordingly, in State $ST_3$, only one data, that is, the lowest one in the data higher than the contents of the priority information $T_1$ through $T_{12}$ among the data in the memory positions $D_1$ through $D_{12}$ of the data register 46 is selected. The lower data are cancelled by the first priority circuit 44, while the upper data are cancelled by the second priority circuit 45, and one data between the upper and lower data is selected. Intermediate data selection employing both of the first and second priority circuits 44 and 45 will be referred to as "masking type priority selection" when applicable, hereinafter.

When the data selected by the masking type priority selection and applied to the lines $L_1$ through $L_{12}$ coincides with the data stored in the chord register 91, the coincidence detection signal COIN is produced. This means that the position of the single data "1" introduced to the lines $L_1$ through $L_{12}$ by the masking type priority selection is coincident with the position of the root note stored in the chord register 91. In this case, the following logical condition is satisfied with the timing of the state control pulse Sy, and the state is shifted to State $ST_5$.

$$ST_3 \cdot Sy \cdot COIN \qquad (\rightarrow ST_5)$$

When the data selected by the above-described masking type priority selection does not coincide with the root note, the coincidence detection signal COIN is at "0", and the following logical condition is established with the timing of hte the state control pulse Sy, as a result of which the state is shifted to $ST_4$.

$$ST_3 \cdot Sy \cdot \overline{COIN} \qquad (\rightarrow ST_4)$$

Processing in State $ST_4$

In this State $ST_4$, when the condition $ST_4 \cdot Sy$ is established with the timing of the state control pulse Sy, the content of the counter 124 (FIG. 1) for generating the priority information $T_1$ through $T_{12}$ is advanced by one count, while the signals "1" are supplied to the right shift control line 64 and hold control line 62 of the register 46. The counter 124 is a ring counter, and therefore the bits $T_1$ through $T_{12}$ are sequentially raised to "1" in correspondence to the count values 1 through 12. As a result, the hold state of the data register 46 is released, and the register 46 is placed in right shift state. Thus, upon application of one clock pulse $\phi$ with the same timing as that of the state control pulse Sy, the content of the data register 46 is shifted by one position right. More specifically, the data in the positions $D_1$ through $D_{11}$ are shifted to the positions $D_2$ through $D_{12}$, while the data in the position $D_{12}$ is shifted to the position $D_1$ through the circulation line 67. When the following logical condition is established, the state control logic 102 operates to return the state to State $ST_3$.

$$ST_4 \cdot Sy \qquad (\rightarrow ST_3)$$

In State $ST_3$, the same processing as that described before is carried out. However, the data applied to the data lines $N_1$ through $N_{12}$ through the data selector 47 by the data register 46 is shifted by one bit further right (higher) than those in the processing in State $ST_3$, and the contents of the priority information $T_1$ through $T_{12}$ are increased by one count. Thus, States $ST_4$ and $ST_3$ are repeated until the coincidence detection circuit 90 provides the coincidence detection signal COIN in State $ST_3$, and upon provision of the coincidence detection signal COIN the state is shifted to $ST_5$.

In State $ST_2$, the counter 124 for generating priority information has been reset. Therefore, in the first State $ST_3$ all the priority information $T_1$ through $T_{12}$ is at "0". When the content of the counter 124 is increased by one count in State $ST_4$, the data of the bit $T_1$ in the priority information $T_1$ through $T_{12}$ is raised to "1", and in the second State $ST_3$ the contents of the priority information $T_1$ through $T_{12}$ are such that only the bit $T_1$ is at "1". Thereafter, whenever State $ST_4$ is repeated, the contents of the priority information $T_1$ through $T_{12}$ employed in State $ST_3$ are succeedingly changed (that is, the data "1" is shifted in the order of $T_1 \rightarrow T_2 \rightarrow T_3 \ldots \rightarrow T_{12}$).

Figure 11:
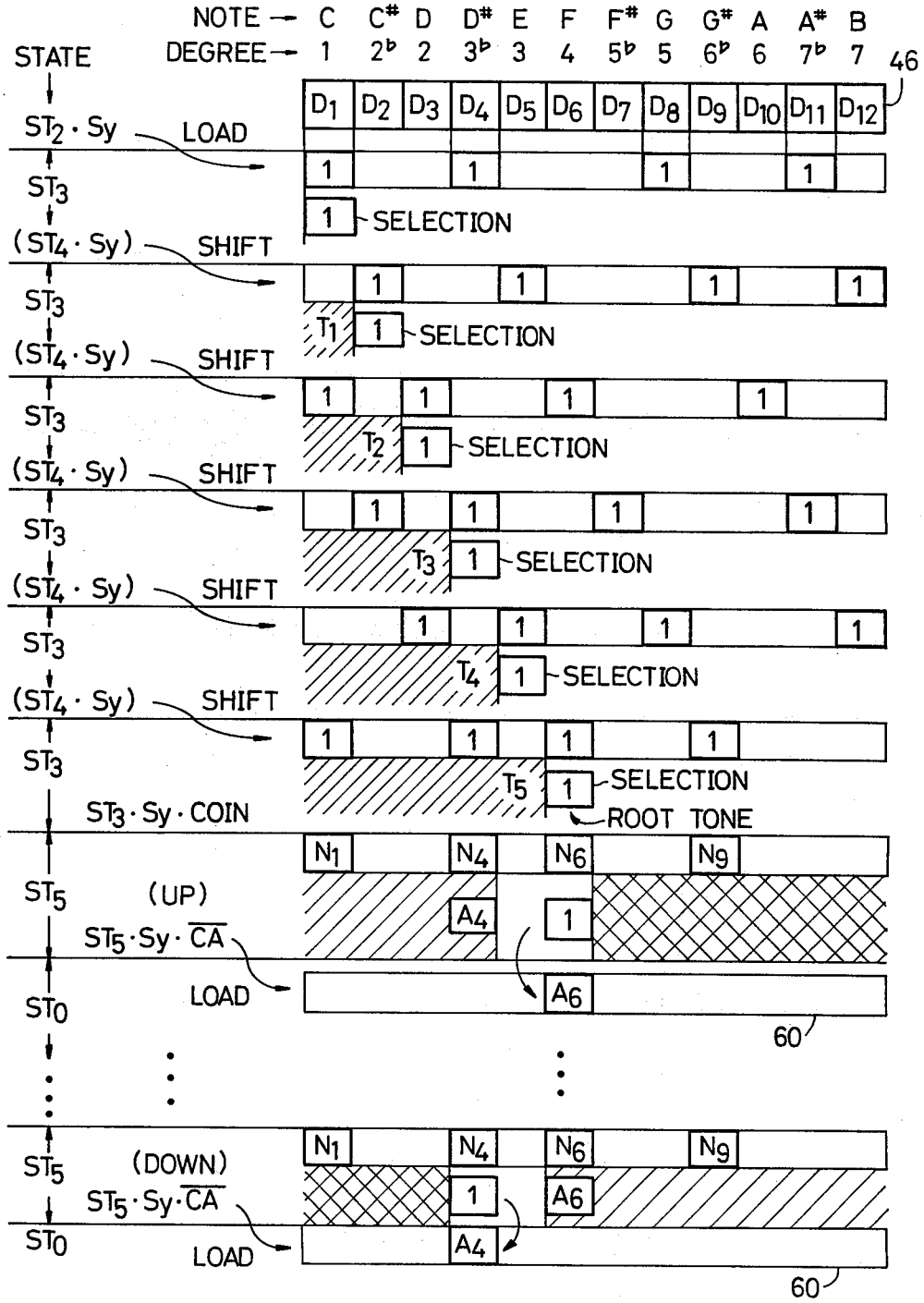
FIG. 11 is an explanatory diagram showing one concrete example of the processing operation of the note information processing device shown in States $ST_3$, $ST_4$ and $ST_4$ indicated in FIG. 10; more specifically, showing the states of data at the positions corresponding to twelve notes (or intervals), and the states of masking type priority selection.

Shown in FIG. 11 is a case where, for instance, a subtone data representing a minor seventh chord is written in the data register 46 from the chord arpeggio subtone data forming logic 59. With reference to this case, the processing in States $ST_3$ and $ST_4$ will be described. In the first State $ST_3$, the signals "1" are stored in the memory positions $D_1$, $D_4$, $D_8$ and $D_{11}$ in the data register 46 which correspond respectively to the prime, minor third, fifth, and minor seventh degrees, respectively. In this case, all the pieces of priority information $T_1$ through $T_{12}$ are at "0", and therefore the first priority circuit 44 (FIG. 4) selects all the data on the data lines $N_1$ through $N_{12}$. The second priority circuit 45 in the lower priority state select the data in the memory position $D_1$ which is the lowest data "1". Now, it is assumed that the signal "1" is stored in the memory position which corresponds to note F, in the chord register 91. As the note of the memory position $D_1$ corresponds to note C, the output of the coincidence detection circuit 90 is at "0", which represents the non-coincidence. Therefore, the state is shifted to State $ST_4$, the contents of the data register 46 are shifted by one bit position right with the timing of the state control pulse Sy, while the bit $T_1$ of the priority information $T_1$–$T_{12}$ is raised to "1".

As a result, in the second State $ST_3$, the signals "1" are stored in the memory positions $D_2$, $D_5$ and $D_{12}$, respectively. When the priority information $T_1$ is raised to "1", in the first priority circuit 44 (FIG. 4) placed in the upper priority state the lowest input data $N_1$ corresponding to the bit $T_1$ is blocked, and therefore the data $N_2$ through $N_{12}$ higher than the data $N_1$ are selected. As the second priority circuit 45 is in the lower priority state, the lowest data "1" in the data in the memory positions $D_2$ through $D_{12}$ applied through $M_2$–$M_{12}$ by the data lines $N_2$–$N_{12}$ is selected with priority. As the data "1" corresponding to the prime interval (root) has been shifted to the memory position $D_2$, the data "1" in this memory position $D_2$ is selected, and the signal "1" is supplied only to the line $L_2$ (FIG. 5) corresponding to note C# in the output lines $L_1$–$L_{12}$ of the second priority circuit 45. In the case where no coincidence detection signal COIN is produced, the state is shifted to State $ST_4$ again. Therefore, the contents of the data register 46 are shifted by one bit position right, and the priority information bit $T_2$ is raised to "1".

Accordingly, in the third State $ST_3$, the signals "1" are stored in the memory positions $D_3$, $D_6$, $D_{10}$ and $D_1$ of the data register 46, respectively. In the first priority circuit 44 in FIG. 4, the priority information $T_2$ signal is at "1", and the signal "1" is applied through the OR circuit 56-2 to the OR circuit 52-2 and 52-1 to disable the AND circuits 50-1 and 50-2. Therefore, the data $N_2$ and $N_1$ lower than the data $N_2$(inclusive) corresponding to the bit $T_2$ are blocked. As the bits $T_3$ through $T_{12}$ are at "0", all the data $N_3$ through $N_{12}$ higher than the priority information bit $T_2$ are selected. Thus, the data in the memory positions $D_3$, $D_6$ and $D_{10}$ are selected and inputted to the second priority circuit 45, and only the data corresponding to the memory position $D_3$ is selected by the second priority circuit 45 with lower priority. In the third State $ST_3$, the data "1" corresponding to the prime has been shifted to the memory position $D_3$. Thereafter, whenever State $ST_4$ is repeated, the contents of the priority information $T_1$–$T_{12}$ are successively changed toward $T_{12}$, while the contents of the data register 46 are successively shifted by one bit right. In FIG. 11, the part lower than the priority information $T_1$, $T_2$ . . . is indicated by the oblique lines, and the part thus indicated by the oblique line is blocked in the upper priority selection of the first priority circuit 44.

As is apparent from FIG. 11, whenever the States $ST_3$ and $ST_4$ are repeated, the values of the priority information $T_1$ through $T_{12}$ are successively changed, while the contents of the data register 46 are also shifted right. Therefore, the single data "1" selected as a result of the aforementioned masking type priority selection employing the first and second priority circuits 44 and 45 corresponds to the prime (root) at all times. The note corresponding to the prime data is successively shifted toward the high tone side as in C→ C#→ D→. . . with the right shifting operation.

When the prime interval data "1" which was at the leftmost memory position $D_1$ in the first State $ST_3$ is provided at the memory position $D_6$ by the fifth right shifting operation, the prime interval becomes correspondent to note F. As was described before, the data corresponding to note F has been stored in the chord register 91 as the root tone. Therefore, in the case of FIG. 11, the coincidence signal COIN is produced in the sixth State $ST_3$, and the state is shifted to State $ST_5$.

In the case where although the highest bit $T_{12}$ of the priority information $T_1$–$T_{12}$ has been raised to "1" as a result of twelve right shifting operations, no coincidence detection signal COIN is produced, it means that the storage of the root data has not been carried out in the side of the chord register 91. Accordingly, in this case, when the following condition is established with the timing of production of the state control pulse Sy, the state is returned to the standby state $ST_0$.

$$ST_3 \cdot Sy \cdot T_{12} COIN \qquad (\rightarrow ST_0)$$

Processing in State $ST_5$

In this state $ST_5$, a single tone to be produced as an arpeggio tone is selected, and the note data thereof is written in the arpeggio register 60. In this case, the selection of the single tone is carried out by the masking type priority selection employing the first and second priority circuits 44 and 45.

In the case of chord arpeggio, the note data stored in the data register 46 is used as an arpeggio tone, one tone thereof being selected. In the last State $ST_3$ immediately before shifting to State $ST_5$, the memory positions $D_1$ through $D_{12}$ of the data register 46 have been made to be correspondent to note C through B by the repetition of the processing in States $ST_3$ and $ST_4$. The reason for this is that the subtone data having a predetermined interval relation is shifted right while maintaining the interval relation, and when the position of the prime data coincides with the note position of the root stored in the chord register 91, the state is shifted from State $ST_3$ to State $ST_5$. In the example shown in FIG. 11, in the last State $ST_3$, the data "1" corresponding to the prime is at the memory position $D_6$ corresponding to the root note F, the data corresponding to the minor third degree is at the memory position $D_9$ corresponding to note G#, the data corresponding to the perfect fifth degree is at the memory position $D_1$ corresponding to note C, and the data corresponding to the minor seventh degree is at the memory position $D_4$ corresponding to note D#. Therefore, the note data of "F minor seventh chord" consisting of notes F, G#, C and D# are stored in the data register 46. As the signal on the hold control line 62 is set at "0", the note data stored in the data register 46 are self-held.

In the case of chord arpeggio, the single finger function selection signal SF is at "1", and when the logical condition $ST_5$, SF is established in State $ST_5$, the signal "1" is applied to the control line 47D of the data selector 47 (FIG. 2) by the control information generating logic 104 (FIG. 1). As a result, in the data selector 47, the data from the memory positions $D_1$ through $D_{12}$ of the data selector 46 are selected and are applied through the data lines $N_1$ through $N_{12}$ to the first priority circuit 44.

In the case of normal arpeggio, the tones of keys actually depressed in the lower keyboard are produced in arpeggio system. In this case, the single finger function selection signal SF is at "0", and when the logical condition $ST_5 \cdot \overline{SF}$ is established in State $ST_5$, the signal "1" is applied to the control line 47L of the data selector 47. As a result, the key depression note data stored in the lower keyboard note memory register 36 is selected by the data selector 47 and applied through the data lines $N_1$ through $N_{12}$ to the first priority circuit 44 where it becomes a data selected.

The order of selecting the note data stored in the data register 46 or the lower keyboard note memory register 36 is in correspondence to the order of producing the arpeggio tone. Tone production in the automatic arpeggio performance is effected in two different orders: one is such that tones are produced starting from the lowest tone, which will be referred to as "an up progression", while the order is such that tones are produced starting from the highest one, which will be referred to as "a down progression". Control for determining whether the tone production order should be placed in the up progression or the down progression is effected by an up-down control section (not shown) provided in the automatic arpeggio control device 13. In the case of the up progression, the up-down control section applies an up signal US (not shown) to the control information generating logic 104, while in the case of the down progression the up-down control section applies a down signal DS (not shown). The note data stored in the data register 46 or the lower keyboard note memory register 36 are sequentially selected starting from the low tone side in the case of the up progression, and are sequentially selected starting from the high tone side in the case of the down progression. However, it should be noted that selection of a single tone is effected only when one arpeggio tone production timing signal APL is applied. Therefore, during one cycle of States $ST_0$ through $ST_6$ for automatic arpeggio only one note is selected, and is stored in the arpeggio register 60. Accordingly, in the arpeggio register 60 the signal "1" is maintained only in the memory position corresponding to the single note thus selected, and this signal "1" is applied to the arpeggio tone source section 93 (FIG. 1) through the corresponding output line (which is one of the lines $A_1$ through $A_{12}$). In the arpeggio tone source section 93, a tone source signal corresponding to the single note stored in the arpeggio register 60 is produced, and the tone source signal, being given with, for instance, a percussion system amplitude envelope, is outputted to the filter 125 (FIG. 1) for tone color control.

Therefore, the note data stored in the arpeggio register 60 when the state is changed from $ST_3$ to $ST_5$ represents the tone produced at the preceding arpeggio tone production timing. In order to successively increase or decrease the tone pitch according to the up progression or the down progression, it is necessary to select a note higher or lower than the note of the precedingly produced tone stored in the arpeggio register 60.

For this purpose, in State $ST_5$, the signal "1" is applied to the control line 49A of the priority information select gate 48, so that the data (representing the note of the precedingly produced tone) $A_1$ through $A_{12}$ representing the contents of the arpeggio register 60 are selected and are employed as the priority information of the first priority circuit 44. In addition, also in the masking type priority selection employing the first and second priority circuits 44 and 45, control is effected according to the up progression or the down progression.

In the case where the aforementioned up-down control section (not shown) designates the up progression, the up signal US is at "1", and when, in State $ST_5$, the condition $ST_5 \cdot US$ is established, the signals "1" are applied to the upper priority control line 44H of the first priority circuit 44 and to the lower priority control line 45L of the second priority circuit 45, respectively. In the first priority circuit 44, the upper priority selection operation is carried out so that all the input data (some of $N_1$–$N_{12}$) corresponding to the notes higher than the note represented by the priority information $A_1$–$A_{12}$ are selected. The data thus selected are introduced to the data lines $M_1$–$M_{12}$ through the OR circuit group 58 and are finally applied to the second priority circuit 45. In the second priority circuit 45, the data "1" of the lowest tone in the note data selected by the first priority circuit 44 is selected.

One example of the masking type priority selection in the case of this up progression is shown in the column of State $ST_5$ of FIG. 11. It is assumed that the data on the lines $N_1$ $N_4$, $N_6$ and $N_9$ in the data input lines of the first priority circuit 44 are at "1". In addition, it is assumed that, in this case, the data of note D# has been stored in the arpeggio register 60. Accordingly, with respect to the priority information $A_1$–$A_{12}$ the bit $A_4$ corresponding to note D# is at "1", and in the first priority circuit 44 the data $N_1$–$N_4$ below the bit $A_4$ (inclusive), or on the side of notes lower than D# (inclusive), are blocked, while the data $N_5$–$N_{12}$ above the bit $A_4$, or on the side of notes higher than note D#, are selected. In the data $N_5$–$N_{12}$ thus selected, the data $N_6$ and $N_9$ are at "1". Accordingly, the second priority circuit 45 selects the data "1" on the input line $M_6$ corresponding to the data $N_6$ which is the signal "1" on the lowest tone side. In the case of FIG. 11, the notes employed as the arpeggio tone are C, D#, F and G# corresponding respectively to the data $N_1$, $N_4$, $N_6$ and $N_9$, and the precedingly produced tone is D#. Thus, a data ($N_6$) corresponding to note F higher than that note D# has been selected.

In the case of the down progression, the down signal DS is at "1", and the condition $ST_5 \cdot DS$ is satisfied in State $ST_5$. According to this, the signals "1" are applied to the lower priority control line 44L of the first priority circuit 44 and to the upper priority control line 45H of the second priority circuit 45, respectively, as a result of which the lower priority selection is effected in the first priority circuit 44, while the upper priority selection is effected in the second priority circuit 45. Accordingly, the data (anyone of $N_1$–$N_{12}$) of notes lower than the note of precedingly produced tone which is represented by the priority information $A_1$–$A_{12}$ are selected in the first priority circuit 44, and the highest of the selected note data is selected in the second priority circuit 45. Thus, in the tones composing the arpeggio tone, the tone lower in pitch than the precedingly produced tone is selected. For instance, it is assumed that, as shown in State $ST_5$ of FIG. 11, the data $N_1$, $N_4$, $N_6$ and $N_9$ are at "1", corresponding respectively to the arpeggio composing tones, and that, in this case, the precedingly produced tone is F and the bit $A_6$ of the priority information $A_1$–$A_{12}$ is at "1". In the first priority circuit 44 the data $N_1$ and $N_4$ corresponding respectively to notes C and D# on the side of notes lower than the preceding note F are selected, while in the second priority circuit 45 the data ($N_4$) corresponding to the highest D# in the notes C and D# is selected. That is, the note D# lower than the preceding note F is selected.

In the case where the precedingly produced tone is the highest of the arpeggio composing tones in the up progression being note G# corresponding to the data $N_9$ in the example of FIG. 11), in the first priority circuit 44 the upper priority selection is effected with the highest tone as the priority information, and therefore all the note data on the side of tones lower than the highest tone (inclusive) are blocked. Accordingly, no signal "1" is applied to the input lines $M_1$ through $M_{12}$ of the second priority circuit 45. In the case where the precedingly produced tone is the lowest of the arpeggio composing tones in the down progression (which is note C corresponding to the data $N_1$ in the example shown in FIG. 11), the first priority circuit 44 operates to select, as priority information, the note data on the side of tones lower than the lowest tone, and to block all the note data on the side of tones higher than the lowest tone (inclusive). Therefore, similarly as in the above-described case, all the data of the input lines $M_1$ through $M_2$ of the second priority circuit 45 are at "0". In this case, the output of the NOR circuit 87 (FIG. 5) of the second priority circuit 45 is raised to "1", as a result of which the carry signal CA is provided. Upon provision of the carry signal CA, the following condition is established with the timing of the state control pulse Sy, as a result of which the state is shifted to $ST_6$ from $ST_5$.

$$ST_5 \cdot Sy \cdot CA \qquad (\rightarrow ST_6)$$

If the precedingly produced tone is not the highest or lowest tone, no carry signal CA is produced, and a single note data is selected for the input lines $M_1$ through $M_{12}$ of the second priority circuit 45. In this case, the following condition is satisfied with the timing of the state control pulse Sy, the signal "1" is applied to the load control line 92 of the arpeggio register 60, and the state is shifted to the standby state $ST_0$ from State $ST_5$.

$$ST_5 \cdot Sy \cdot \overline{CA} \qquad (\rightarrow ST_0)$$

Accordingly, in the arpeggio register 60, its self-holding operation is released so as to erase the storage of the note of the precedingly produced tone and to write and store a single new note data applied through the lines $L_1$ through $L_{12}$. On the other hand, the arpeggio tone source section 93 operates to produce a tone source signal corresponding to the note newly stored in the arpeggio register 60. Thus, the arpeggio tones are produced one at a time in the order of tone pitch at predetermined time intervals.

If no carry signal CA is produced as was described, the state is shifted to State $ST_0$ from State $ST_5$. In this case, when the following condition is established, the reset signal from the control information generating logic 104 is applied to the arpeggio tone production timing memory 122 (FIG. 1) to reset the storage APLM in the memory 122.

$$ST_5 \cdot Sy \cdot \overline{CA}$$

This memory 122 is not set until the next arpeggio tone production timing signal APL is applied thereto. Accordingly, until the production of the next arpeggio tone production timing signal APL the condition for shifting the state from $ST_0$ to $ST_1$ is not established, that is, the standby State $ST_0$ is maintained. Therefore, the process by States $ST_1$–$ST_5$ (or $ST_6$) for selection and production of a single tone in the arpeggio tones is carried out as much as one cycle when one arpeggio tone production timing signal APL is produced. According to this process, one tone selected is immediately produced by the arpeggio tone source section 93, and therefore the tone production time intervals of the tones forming the arpeggio correspond to the production time intervals of the arpeggio tone production timing signals APL.

When the carry signal CA if produced, the state is shifted to State $ST_6$ from State $ST_5$ as was described before. In this case, when the condition $ST_5 \cdot Sy \cdot CaA$ is established, the octave process signal OCP (not shown) from the control information generating logic 104 is applied to the up-down control section (not shown). This up-down control section carries out the process of switching the octave range of a tone provided by the arpeggio tone source section 93 according to the octave process signal OCP and of switching the production tone pitch order of arpeggio tones to that of the up progression or to the down progression, and makes preparation for carrying out the process of State $ST_6$ in the note information processing device 11.

Automatic arpeggio has two tone production modes: one is "a turn mode" in which increment and decrement in produced tone pitch are repeated over one or plual octaves, i.e. the up progression and the down progression are alternately repeated, and the other is "an up mode" in which only increment in produced tone pitch is repeated over one or plural octaves, i.e. only the up progression is repeated. In this case, the highest octave can be set to a desired value by the performer. In the aforementioned up-down control section, a turn mode selection signal TM (not shown) is at "1" when the "turn mode" automatic arpeggio is selected, and an up mode selection signal UM (not shown) is a "1" when the "up mode" automatic arpeggio is selected. Furthermore, when the octave range of the present arpeggio tone is the highest octave set by the performer, a set octave detection signal OSE (not shown) is at "1"; however, when it is not the highest octave, the signal OSE is at "0" (or $\overline{OSE}$ is at "1"). In addition, when the octave range of the present arpeggio tone is the fundamental octave (or the lowest octave), a zero octave detection signal OZ (not shown) is at "1", however, when it is not the fundamental octave, the signal OZ is at "0" (or $\overline{OZ}$ is at "1"). If the present arpeggio tone production tone pitch order is of the up progression, the up signal US is at "1" and if it is of the down progression, the down signal DS is at "1".

Utilizing information representing the above-described octave range and up-down state, the up-down section performs the following AND logics when the octave process signal OCP is produced, and carries out the octave process and the up-down according to the AND logic whose conditions are satisfied:

$$US \cdot \overline{OSE} \cdot OCP \quad (5)$$

$$DS \cdot \overline{OZ} \cdot OCP \quad (6)$$

$$UM \cdot US \cdot OSE \cdot OCP \quad (7)$$

$$TM \cdot US \cdot OSE \cdot OCP \quad (8)$$

$$DS \cdot OZ \cdot OCP \quad (9)$$

In the case when the logical condition (5) is established, as the octave range is not reached to the highest octave ($\overline{OSE}$) in the up progression (US), the process of increasing the octave range of the present arpeggio tone by one octave is carried out. In the case where the logical condition (6) is established, as the octave range is not reached to the lowest octave ($\overline{OZ}$) in the down progression (DS), the process of decreasing the octave range of the present arpeggio tone by one octave is carried out. When the logical condition (7) is established, the octave range reaches the highest octave (OSE) in the up mode (UM), and therefore the process of returning the octave range of the present arpeggio tone to the lowest octave is carried out. The process according to the logical expressions (5) through (7) is carried out by adding one to or subtracting one from the value of an octave counter (not shown) representing the octave range of the present arpeggio tone or by resetting the value of the octave counter. The count content of the octave counter is applied, as octave information OCTV, to the arpeggio tone source section 93, and therefore the octave range of the note data applied through the lines $A_1$–$A_{12}$ to the arpeggio tone source section 93 is specified.

In the case where any one of the logical expressions (5), (6) and (7) is established, an octave process for the aforementioned octave counter (not shown) is carried out as described above. In this case, during the next State $St_6$, an octave process finish signal POC (not shown) is stored for control.

In the case where the logical expression (8) is established, the highest octave is obtained (OSE) in the up progression (US) of the turn mode (TM), and therefore the up progression is changed to the down progression state. Therefore, from the next State $ST_6$, the down signal DS is raised to "1". This is a process effected at the turning point on the highest tone side in the tone pitch variation in the arpeggio performance. More specifically, in the case where the tone pitch is successively increased in the up progression in the highest octave range, the carry signal CA is outputted in the state process effected after the highest tone is produced. Therefore, when the logical expression (8) is established, the up progression is replaced by the down progression so that, the tone pitch is successively decreased in the highest octave range.

When the logical expression (9) is established, the lowest octave is obtained (OZ) in the down progression (DS), and therefore the process of switching the down progression to the up progression is carried out. This is a process effected at the turning point on lowest tone side in the tone pitch variation in the arpeggio performance. In other words, the tone pitch variation, having been decreased in the down progression in the lowest octave range, is now increased from the lowest octave range. In the process based on the logical expressions (8) and (9), the octave switching is not carried out. The signals US and DS representing respectively the up state and the down state can be formed by using a 1-bit flip-flop circuit (not shown).

When the carry signal CA is outputted, the above-described process is carried out by the up-down control section with the last timing of State $ST_5$, and one bit time thereafter the state is shifted to State $ST_6$.

Processing in State $ST_6$

In State $ST_6$, a process substantially similar to that in State $ST_5$ is carried out in the note information processing device 11. However, as the suitable processes have been carried out in accordance with the logical expressions (5) through (9) with the last timing of State $ST_5$, a single tone selection can be positively carried out without producing the carry signal CA.

In the case of the chord arpeggio, in State $ST_6$ the condition $ST_6 \cdot SF$ is established, as a result of which the signal "1" is applied to the control line 47D of the data selector 47, and the data in the memory positions $D_1$ through $D_{12}$ of the data register 46 are selected.

In the case of the normal arpeggio, the condition $ST_6 \cdot \overline{SF}$ is established. According to this condition, the signal "1" is applied to the control line 47L of the data selector 47, and the key depression note data stored in the lower keyboard note memory register 46 is selected. Furthermore, in the case of the up progression the condition $ST_6 \cdot US$ is established, as a result of which the signals "1" are supplied tothe upper priority control line 44H of the first priority circuit 44 and to the lower priority control line 45L of the second priority circuit 45, respectively. In the case of the down progression, the condition $ST_6 \cdot DS$ is established, as a result of which the signals "1" are applied to the lower priority control line 44L of the first priority circuit 44 and to the upper priority control line 45H of the second priority circuit 45, respectively.

The condition for using the note data $A_1$–$A_{12}$ of the previous tone stored in the arpeggio register 60 as the priority information in the first priority circuit 44 is $\overline{ST_6 \cdot POC}$. When this condition is satisfied, the signal "1" is applied to the control line 49A of the priority information select gate 48.

In the case where the octave process based on any one of the above-described logical expressions (5) through (7) has been carried out with the timing of production of the state control pulse Sy at the end of the above-described State $St_5$, the octave process finish signal POC is at "1". In this case, the aforementioned condition is not established, and therefore the control line 49A of the select gate 48 has the signal "0". Therefore, in the first priority circuit 44 the priority information $A_1$–$A_{12}$ is not used, and all the priority information applied through the OR circuits 56-1 through 56-12 (FIG. 4) of the gate 48 is at "0". When all the priority information is at "0", in the first priority circuit 44 carries out no priority selection, that is, the input data $N_1$ through $N_{12}$ are passed as they are. Accordingly, only one highest or lowest tone is selected by the upper or lower priority operation of the second priority circuit 45. In the case of the up progression, the highest tone in one octave has been produced precedingly, and therefore the carry signal is produced is State $ST_5$, and in the next State $ST_6$ the lowest tone is selected by the lower priority operation of the second priority circuit 45. This lowest tone is produced in an octave range higher by one octave than that of the preceding highest tone. In the case of the down progression, the lowest tone has been produced precedingly, as a result of which the carry signal CA is produced in State $ST_5$, and in the next State $ST_6$ the highest tone is selected by the upper priority operation of the second priority circuit 45. This highest tone is produced in an octave range lower by one octave than that of the preceding lowest tone.

When the process of the aforementioned up-down control section is carried out in accordance with the logical expression (8) or (9), the octave process finish signal POC is not produced, and therefore the signal "1" is applied to the control line 49A of the select gate 48. As a result, the note data of the previously produced highest or lowest tone is employed as the priority information $A_1$–$A_{12}$ of the first priority circuit 44. However, it should be noted that the up progression or the down progression is opposite to that in State $ST_5$ by the up-down switching process base on the logical expression (8) or (9). Accordingly, the direction of priority in the first and second priority circuits is reverse to that in the case of the State $ST_5$. Thus, in the case where the precedingly produced tone is the highest tone, the note data lower in tone pitch than that tone is selected; while in the case where the precedingly produced is the lowest tone, the note data higher in tone pitch than that tone is selected. Accordingly, in the "turn mode" arpeggio, the highest or lowest tone is produced only once at the turning point in the tone pitch variation.

When the condition $ST_6 \cdot Sy \cdot \overline{CA}$ is satisfied with the timing of production of the control pulse Sy, the signal "1" is applied to the load control line 92 of the arpeggio register 60, so as to write the single note data selected by the lines $L_1$ through $L_{12}$ in the arpeggio register 60. Simultaneously, the reset signal from the control information generating logic 104 is applied to the arpeggio tone production timing memory 122 (FIG. 1) to reset the storage APLM in the memory 122. In addition, the following condition is established with the timing of the state control pulse Sy, and the state is returned to the standby State $ST_0$.

$$ST_6 \cdot Sy \qquad (\rightarrow ST_0)$$

When the state is returned to the standby state $ST_0$ after the completion of one cycle of state process in the automatic arpeggio control device 13, the time division operation control signal T′ is applied to the automatic bass chord control device 12. Thus, the process in the note information processing device 11 is carried out in accordance with the control of the automatic bass chord performance device 12 again.

In the above-described embodiment, the note information processing device 11 is used, in time division manner, commonly for the automatic bass chord performance and the automatic arpeggio performance; however, the note information processing device 11 may be used, in time division manner, commonly for other automatic performance functions. Furthermore, the arrangement of the processing device 11 is not limited to that shown in FIG. 2, that is, the processing device 11 may have a suitable arrangement depending on the automatic performance functions for which the processing device 11 is intended to be used, in time division manner, commonly.

As is apparent from the above description, according to this invention, a plurality of different automatic performance can be effected merely by using one note information processing device, which contributes to simplification of the circuitry and accordingly to reduction of the manufacturing cost. Furthermore, since a desired process can be carried out merely by changing the method of applying control information to the note information processing device 11, the number of automatic performances effected simultaneously and the functions thereof can be readily changed merely by changing the arrangements of the control devices 12 and 13 or by adding other control devices.

What is claimed is:

1. An electronic musical instrument comprising:

keys;

note information generation means for generating upon depression of the keys a plurality of note information representative of notes to be sounded in relation to the key depression;

selection means for selecting a note information representative of a note to be sounded from among said plurality of information from the note information generation means in accordance with a predetermined priority order;

output means for storing and delivering out the note information selected by said selection means; and a tone producing means for producing each tone designated by the note information delivered out from said output means, said selection means operating repetitively to select successive notes to be sounded and including masking type priority selection logic interconnected to said output means for selecting from said plurality of information the note information which is next in said predetermined priority order with respect to the note information which was stored in and delivered out from said output means at the preceding repetitive operation of said selection means.

2. An electronic musical instrument as defined in claim 1 wherein said selection means comprises:

a first circuit for inhibiting data which are of higher (or lower) order than an order designated by the note information stored in said output means and selecting the rest of data among a plurality of data to be selected which are arranged in a predetermined order; and a second circuit for inhibiting data of lower (or higher) order and selecting the rest of data among the data selected by said first circuit;

data of desired intermediate order being thereby selected.

3. An electronic musical instrument as defined in claim 2 wherein said second circuit preferentially selects single data which is of the highest (or lowest) order among the data selected by said first circuit.

4. An electronic musical instrument as defined in claim 3 wherein said note information generation means generate information of a plurality of tones which are in a predetermined note interval relation to a root note selected by key depression.

5. An electronic musical instrument comprising:

keys;

note information generation means for generating information of a plurality of notes which are in predetermined note interval relations to a root note selected by depression of said keys; and selection means for selecting information of a desired note among the information of the plurality of notes generated by said note information generation means at desired time intervals;

tones corresponding to the selected information being thereby produced; and wherein said note information generation means stores data representing a plurality of note intervals corresponding to a desired type of chord at predetermined memory positions in a shift register in order of the note intervals and includes means for providing the note information by shifting the respective data until the stored prime interval indicative datum for said chord type is situated at a certain memory position corresponding to said selected root note.

6. An electronic musical instrument comprising:

keys;

processing means for carrying out one or more processes selected from the group including chord detection, root tone detection and single-tone selection according to note information specified by depression of said keys, and in response to control information; and control means for supplying to said processing means control information required for carrying out a plurality of automatic performances such as an automatic bass chord performance and an automatic arpeggio performance, in a time division manner, with respect to each function of said automatic performances, processing for said plurality of automatic performances being thereby effected in a time division manner in said processing means.

7. In an electronic musical instrument, an arpeggio production system comprising:

a data register having a separate storage position corresponding to each note name, chord data entry means for entering into said data register subtone degree data indicative of the prime and intervals of a chord, the prime-indicative datum being entered in the storage position corresponding to the note name of the chord root, an "arpeggio" register also having a separate storage position corresponding to each note name and storing a single signal in the storage position corresponding to the note name of the last produced arpeggio tone, and masking type priority selection means, cooperating with said data register and said "arpeggio" register, for comparing the contents of said data register and said "arpeggio" register and for selecting the interval indicative datum in said data register which is next in preselected order with respect to the note name of said last produced arpeggio tone, said selected datum being usable to control production of the next arpeggio tone.

8. An electronic musical instrument according to claim 7, said instrument having a keyboard, and wherein said chord data entry means comprises:

a "chord" register having a separate storage position corresponding to each note name, and root entry means, responsive to depression of at least one key, for entering into one position of said "chord" register a signal indicative of a chord root, subtone data forming logic for entering said subtone degree data into said data register with said prime-indicative datum in an arbitrary position, and controlled circulation means, cooperating with said data register and said "chord" register, for circulating said subtone degree data in said data register and for terminating said circulation when the storage position of said prime-indicative datum coincides in note name with said one position in said "chord" register containing said chord root indicative signal.

9. An electronic musical instrument according to claim 8, said instrument also including an automatic bass chord production device, certain components of said arpeggio production system including said "chord" register and said root entry means being time chared with said automatic bass chord production device, said root entry means functioning during operation of said automatic bass chord production device so that said entered chord root indicative signal indicates the root note used for automatic bass chord production.

10. An electronic musical instrument according to claim 8 wherein each of said arpeggio production system and said automatic bass chord production device includes separate state control logic for separately programmatically controlling said certain time shared components.

11. In an electronic musical instrument, an automatic bass chord performance device comprising:

a data register having a separate storage position corresponding to each note name, means for entering data into said data register in those storage positions corresponding to the names of selected notes, chord detect logic means for circulating said entered data in said data register and for terminating said circulation upon detection of a chord type represented by said circulated data with the prime of said chord at a specified position in said data register, shifting means for shifting the data in said data register without recirculation until the total number of positions said data was circulated and shifted corresponds to the number of storage positions in said data register, whereby the root of said chord is represented by the position of the stored datum nearest one extremity of said data register, and priority gating means for extracting said root indicative datum from said data register.

12. In a keyboard electronic musical instrument, the improvement for time shared implementation of plural automatic performance devices comprising:

note information processing device means for receiving data representing depressed keys and for performing on said data one or more functions selected from the group including chord type detection, chord root note detection, highest or lowest played note detection, chord formation using a single played note as a root, and sequential note selection, at least two automatic performance devices each including a state counter and an associated information generation logic means, responsive to the contents of the associated state counter, for programmatically controlling said note information process device means to perform a sequence of selected functions to accomplish an automatic performance, and enabling means, interconnecting said at least two automatic performance devices for inhibiting all other such devices while the state counter and logic of any one device is controlling said note information processing device.

13. A keyboard electronic musical instrument according to claim 12 wherein one of said devices is an automatic arpeggio performance device, said note information processing device including an "arpeggio" register means for storing a signal designating the arpeggio tone last produced, said instrument further comprising:

arpeggio timing control means for providing an arpeggio timing signal each time that a new arpeggio tone is to be produced, said enabling means being connected to said arpeggio timing control means so as to enable said automatic arpeggio performance device as soon after occurrence of each arpeggio timing signal as said arpeggio performance device is no longer inhibited by operation of another automatic performance device.

14. In an electronic musical instrument in which notes are represented by signals on a set of note-name corresponding lines, a first priority selection circuit means, having a data input to which an input set of note-name corresponding lines is connected, having an output to which an output set of note-name corresponding lines is connected, and having a priority position control input to which a priority position defining control signal is applied, for gating to said output only those signals present on lines of said input set having an order in a specified relationship with respect to the priority position defined by said control signal, and control means for providing to said control input a programmatically changing control signal which at different times defines different priority positions.

15. An electronic musical instrument according to claim 14 wherein, in said first priority selection circuit means, said specified relationship is selectable to be either of higher or lower order than said defined priority position, together with;

a second priority selection circuit means, connectable in circuit with said input or said output set of note-name corresponding lines, for gating through only the signal of selectably highest or lowest priority order, and wherein;

said control means also provides order establishing control signals to cause said first priority selection circuit means to pass signals only of a selected one of higher or lower order relationship with respect to said priority position and to cause said second priority selection circuit means to pass only the other respectively lowest or highest order signal, said first and second priority selection circuit means thereby cooperating to select out a signal on a single note-name corresponding line.

16. An electronic musical instrument according to claim 15 and utilized in an automatic arpeggio tone production system, said control means providing control signals which sequentially define priority positions corresponding to sequentially produced arpeggio tones, whereby said first and second priority selection circuit means programmatically select out each arpeggio tone next to be produced in accordance with the previously produced tone.

* * * * *